US007837840B2

(12) United States Patent
Sugiura et al.

(10) Patent No.: US 7,837,840 B2
(45) Date of Patent: Nov. 23, 2010

(54) SURFACE TREATMENT APPARATUS FOR SMALL OBJECT

(75) Inventors: Yutaka Sugiura, Hirakata (JP); Tomoji Okuda, Hirakata (JP); Hideki Nakada, Hirakata (JP)

(73) Assignee: C.Uyemura & Co., Ltd., Osaka-shi (JP)

( * ) Notice: Subject to any disclaimer, the term of this patent is extended or adjusted under 35 U.S.C. 154(b) by 833 days.

(21) Appl. No.: 11/808,744

(22) Filed: Jun. 12, 2007

(65) Prior Publication Data

US 2008/0006527 A1 Jan. 10, 2008

(30) Foreign Application Priority Data

Jul. 6, 2006 (JP) ..... 2006-186569

(51) Int. Cl.
*C25D 17/00* (2006.01)

(52) U.S. Cl. ..... 204/213; 204/272

(58) Field of Classification Search ..... 204/213, 204/272, 273, 275; 205/144, 145, 149; 427/212
See application file for complete search history.

(56) References Cited

U.S. PATENT DOCUMENTS

| | | | | |
|---|---|---|---|---|
| 5,487,824 | A | 1/1996 | Griego | |
| 5,879,520 | A | 3/1999 | Griego | |
| 6,287,444 | B1 * | 9/2001 | Nishiuchi et al. | 205/128 |
| 6,562,217 | B1 * | 5/2003 | Tanaka et al. | 205/143 |

FOREIGN PATENT DOCUMENTS

| | | | |
|---|---|---|---|
| JP | 3126867 | B2 | 11/2000 |

* cited by examiner

*Primary Examiner*—Luan V Van
(74) *Attorney, Agent, or Firm*—Crowell & Moring LLP

(57) ABSTRACT

A plating process apparatus (1) for small objects, including a treatment cell (2) formed by combining a base plate (23), a bottom plate (24), an electrode ring (21) and a cover (25) using bolts (26), energizes a plating solution within the treatment cell (2) while bringing the small objects (100) into contact with the electrode ring (21) and circulating the plating solution (4) from the inside of the treatment cell (2) to the outside thereof through a flow-out means by rotating the treatment cell (2) with a vertical rotation shaft (3), thereby plating the small objects (100). The apparatus (1) is characterized in that the flow-out means is a gap channel formed between adjacent sheet members (61) by sandwiching the sheet members (61), each having a dimension smaller than a minimum dimension of each small object (100), between the bottom plate (24) and the electrode ring (21) circumferentially at appropriate intervals.

20 Claims, 35 Drawing Sheets

SURFACE TREATMENT APPARATUS FOR SMALL OBJECT

TECHNICAL FIELD

The present invention relates to surface treatment apparatuses for small objects, which are suitable for surface treating small objects (small components) such as a powdery work having a size of 0.5 to 5000 μm, a chip condenser, a diode, a connector, a reed switch, a nail, a bolt, a nut, and a washer, for example. It should be noted that surface treatment includes: (1) an electroplating process; (2) an electroless plating process, e.g., an immersion plating process or a chemical plating process; (3) a composite plating process or a chemical composite plating process; (4) an electrodeposition coating process, e.g., an anion electrodeposition coating process or a cation electrodeposition coating process; (5) a pretreatment, e.g., a degreasing process, an electrolytic degreasing process, a barrel polishing process, an alkaline immersion cleaning process, a pickling process, an acid electrolytic process, a chemical polishing process, an electropolishing process, or a neutralization process; and (6) a post treatment, e.g., a draining-induced tarnish prevention process, a water-soluble resin process, or a chromate process.

BACKGROUND ART

FIG. 57 is a schematic front cross-sectional view showing a plating process apparatus as illustrated in Patent Document 1, serving as a type of conventional surface treatment apparatuses for small objects. This plating process apparatus 1 is formed so as to energize (turn on electricity) a plating solution 4 within a treatment cell 2 from an electrode 45 while bringing small objects 100 into contact with an electrode ring 21 and circulating the plating solution 4 from the inside of the treatment cell 2 to the outside thereof by rotating the treatment cell 2 containing the small objects 100 with a vertical rotation shaft 3, thereby plating the small objects 100. The treatment cell 2 has a flow-out means for circulating the plating solution 4 from the inside of the treatment cell 2 to the outside thereof. In the plating process apparatus 1, the plating solution 4 is discharged from a nozzle 41 to the inside of the treatment cell 2, flowed out and scattered from the treatment cell 2 through the flow-out means, received and collected by a case 42, and discharged from the nozzle 41 by a pump 43. In other words, the plating solution 4 is repeatedly used while being cycled. Furthermore, in the plating process apparatus 1, a porous ring 22 is used as the flow-out means. The porous ring 22 is formed by sintering granular resin, internally has openings, and functions as a filter that prevents small objects from passing therethrough but allows only the plating solution 4 to pass therethrough. The plating solution 4 passes through the openings of the porous ring 22.

On the other hand, a flow-out means serving as an alternative to the porous ring 22 seems to be illustrated in Patent Document 2, whereas its details are uncertain.

[Patent Document 1] Japanese Patent No. 3126867.

[Patent Document 2] U.S. Pat. No. 5,879,520.

DISCLOSURE OF THE INVENTION

Problems to be Solved by the Invention

The following problems have become conspicuous in the flow-out means consisting of the porous ring 22.

(1) Breakage of Small Object

The porous ring 22 is formed by sintering granular resin, and thus has irregularities on its surface. Therefore, small objects might collide against these irregularities and might be broken. To cope with this, a cutting work has been performed on the surface in an attempt to planarize the surface; however, since the porous ring 22 has openings, even if a cutting work is performed on the surface, irregularities appear after the cutting, and therefore, it has been impossible to avoid the breakage of the small objects.

(2) Occurrence of Clogging

Broken pieces of small objects, broken pieces of an electrode, dusts in air or the like have clogged the openings of the porous ring 22, thus interfering with the cycle of the plating solution 4. To cope with this, a chemical agent has been used in an attempt to dissolve clogged substances, whereas no effect has been shown on an acid-insoluble substance. Accordingly, it has been necessary to replace the porous ring with a new one every time clogging occurs, thereby causing a cost increase.

(3) Reduction in Function

The porous ring 22 is subjected to a cutting work so as to be attached to the treatment cell 2, and during this time, the cut face is dissolved and/or deformed due to the heat generated by the cutting work, which has sometimes partially clogged the openings. If the openings have been partially clogged, the amount of the plating solution passing therethrough is correspondingly decreased, thus reducing the function of the porous ring as the flow-out means.

(4) Uneconomical Factors (a) The pore diameter of each opening of the porous ring 22 must be smaller than the minimum dimension of each small object, and is thus determined depending upon the dimension of each small object. Further, since the porous ring 22 is formed by sintering granular resin, the pore diameter of each opening of the obtained porous ring 22 has a fixed value that is unchangeable. Therefore, if the pore diameters need to be changed because the small objects have been changed, it has been necessary to form a new porous ring. However, it is uneconomical to prepare a large number of porous rings so as to cope with various dimensions of the small objects.

(b) If the circulation amount of the plating solution 4 is desired to be adjusted, it is only necessary to increase the area of an inner circumferential face of the porous ring 22, i.e., it is only necessary to increase the thickness of the porous ring 22; however, it is impossible to increase the thickness of the porous ring 22 that has once been formed. Therefore, if the circulation amount of the plating solution 4 is desired to be adjusted, it has been necessary to form a new porous ring. However, it is uneconomical to prepare a large number of porous rings so as to cope with various circulation amounts.

(5) Inaccuracy

Since the porous ring 22 is formed by sintering granular resin, the pore diameter or hole ratio of each opening might sometimes not be set at a predetermined value. Therefore, sometimes, it has been impossible to accurately achieve the predetermined functions.

The problems as those described above have also been conspicuous in other surface treatment apparatuses structured similarly to the foregoing apparatus.

An object of the present invention is to provide surface treatment apparatuses for small objects, including flow-out means that can solve all the problems as those described above.

Solution to the Problems

A first invention of the present application is a surface treatment apparatus for a small object, which includes: a treatment cell; and a vertical rotation shaft for rotating the treatment cell around its rotational center on a horizontal plane, and which performs a surface treatment on the small object while flowing out a surface treatment solution from the inside of the treatment cell to the outside thereof by rotating the treatment cell containing the small object, and the apparatus is characterized in that: the treatment cell has a structure provided by superposing and combining a nonconductive bottom plate and a cover, and has a flow-out means for flowing out the surface treatment solution from the inside of the treatment cell to the outside thereof; and the flow-out means is a gap channel formed between adjacent thin plate members by sandwiching the thin plate members, each having a thickness smaller than a minimum dimension of each small object, between the bottom plate and the cover circumferentially at appropriate intervals.

A second invention of the present application is a surface treatment apparatus for a small object, which includes: a treatment cell; and a vertical rotation shaft for rotating the treatment cell around its rotational center on a horizontal plane, and which performs a surface treatment on the small object while flowing out a surface treatment solution from the inside of the treatment cell to the outside thereof by rotating the treatment cell containing the small object, and the apparatus is characterized in that: the treatment cell has a structure provided by superposing and combining a nonconductive bottom plate and a cover, and has a flow-out means for flowing out the surface treatment solution from the inside of the treatment cell to the outside thereof; and the flow-out means is a gap channel consisting of a groove channel formed between the cover and the bottom plate so as to be communicated with the inside and outside of the treatment cell and so as to have a depth smaller than a minimum dimension of each small object.

The first invention of the present application further preferably adopts the specific structure (i), (iii), (v), (vi) or (viii) described below, and the second invention of the present application further preferably adopts the specific structure (ii), (iv), (v), (vii) or (viii) described below.

(i) The treatment cell has an electrode ring between the bottom plate and the cover and has an energization means for energizing the electrode ring, the surface treatment solution within the treatment cell is energized while the small object is brought into contact with the electrode ring and the surface treatment solution is flowed out from the inside of the treatment cell to the outside thereof by rotating the treatment cell containing the small object, thereby performing a surface treatment on the small object, and the flow-out means is formed at least between the bottom plate and the electrode ring, between electrode ring layers of the electrode ring having a multilayer structure, or between the electrode ring and the cover.

(ii) The treatment cell has an electrode ring between the bottom plate and the cover and has an energization means for energizing the electrode ring, the surface treatment solution within the treatment cell is energized while the small object is brought into contact with the electrode ring and the surface treatment solution is flowed out from the inside of the treatment cell to the outside thereof by rotating the treatment cell containing the small object, thereby performing a surface treatment on the small object, and the flow-out means is formed at least between the electrode ring and the bottom plate, between electrode ring layers of the electrode ring having a multilayer structure, or between the cover and the electrode ring.

(iii) An arbitrary number of the thin plate members are sandwiched in a superposed state.

(iv) A plurality of the groove channels are communicated with each other via a cutout portion formed by cutting out an inner edge of an abutment face at which the groove channels are formed.

(v) A peripheral edge portion of the bottom plate is protuberant, and an inner face of the peripheral edge portion is inclined downward and inward.

(vi) The thin plate members are arranged circumferentially at arbitrary intervals.

(vii) The groove channel is provided to have an arbitrary width.

(viii) The apparatus includes an attachment and detachment means for detachably fixing the treatment cell to the vertical rotation shaft, the attachment and detachment means is formed to include: a horizontal receiving plate which is fixed at an upper end of the vertical rotation shaft and on which the treatment cell is placeable; a tapered concave portion formed at a rotational center of the receiving plate; a convex portion provided at a rotational center of a lower face of the treatment cell and fitted into the concave portion; protrusive portions provided at a plurality of positions of the receiving plate so as to be able to be protruded from an upper face thereof; and hole portions formed at the lower face of the treatment cell so that the protrusive portions, protruded from the upper face of the receiving plate, are fitted into the hole portions, and a rotational force of the vertical rotation shaft is transmitted to the treatment cell via the receiving plate in the state where the convex portion of the treatment cell is fitted into the concave portion of the receiving plate and the protrusive portions of the receiving plate are fitted into the hole portions of the treatment cell.

Effect of the Invention

According to the first invention of the present application, only the surface treatment solution can be circulated from the inside of the treatment cell to the outside thereof through the gap channels. Accordingly, a surface treatment can be performed on the small objects.

In addition, the conventional problems can be solved as described below.

(1) Since a conventional porous ring made of sintered resin is not used, the breakage of the small objects due to the collision thereof against the surface irregularities of the porous ring can be completely prevented. Accordingly, the breakage of the small objects can be suppressed.

(2) Since the breakage of the small objects can be suppressed, the clogging of the gap channels by broken pieces of the small objects can be suppressed. In addition, the structure of the gap channels is not as complicated as that of openings of a conventional porous ring, and therefore, the clogging is unlikely to occur. Accordingly, it is possible to suppress the unfavorable performance of a surface treatment resulting from the clogging of the gap channels.

Moreover, even if broken pieces of the small objects or dusts in air, for example, have clogged the gap channels, the treatment cell can be easily disassembled and cleaned, and therefore, the clogging can be easily removed. Furthermore, since the treatment cell can be used over and over by easily removing the clogging thereof, it does not have to be replaced with a new one unlike a conventional porous ring, and therefore, cost reduction can be achieved.

(3) Since a conventional porous ring made of sintered resin is not used, a cutting work operation for sintered resin is unnecessary. Accordingly, a reduction in the function of the flow-out means due to the heat generated during a cutting work never occurs.

(4) Even if the small objects are replaced with ones having different dimensions, the gap channels each having correspondingly appropriate height dimensions can be formed easily and economically by preparing the thin plate members having various thicknesses.

Further, the circulation amount of the surface treatment solution per unit time (which will hereinafter be simply called a "circulation amount") can be adjusted easily and economically by preparing the thin plate members having various outer, diameters.

(5) Since the thickness and the outer diameter of each thin plate member can be set with accuracy, the height and width of each gap channel can be set with accuracy. Accordingly, the functions of the gap channels can be properly achieved, and therefore, the circulation amount of the surface treatment solution can be set with accuracy.

According to the second invention of the present application, only the surface treatment solution can be circulated from the inside of the treatment cell to the outside thereof through the gap channels. Accordingly, a surface treatment can be performed on the small objects.

In addition, the conventional problems can be solved as described below.

(1) Since a conventional porous ring made of sintered resin is not used, the breakage of the small objects due to the collision thereof against the surface irregularities of the porous ring can be completely prevented. Accordingly, the breakage of the small objects can be suppressed.

(2) Since the breakage of the small objects can be suppressed, the clogging of the gap channels by broken pieces of the small objects can be suppressed. In addition, the structure of the gap channels is not as complicated as that of openings of a conventional porous ring, and therefore, the clogging is unlikely to occur. Accordingly, it is possible to suppress the unfavorable performance of a surface treatment resulting from the clogging of the gap channels.

Moreover, even if broken pieces of the small objects or dusts in air, for example, have clogged the gap channels, the treatment cell can be easily disassembled and cleaned, and therefore, the clogging can be easily removed. Furthermore, since the treatment cell can be used over and over by easily removing the clogging thereof, it does not have to be replaced with a new one unlike a conventional porous ring, and therefore, cost reduction can be achieved.

(3) Since a conventional porous ring made of sintered resin is not used, a cutting work operation for sintered resin is unnecessary. Accordingly, a reduction in the function of the flow-out means due to the heat generated during a cutting work never occurs.

(4) As long as the small objects are gradually replaced with ones having larger minimum dimensions, the depth of each groove channel is gradually increased, thus enabling the reuse of the flow-out means. Accordingly, the present invention is economical.

Further, if the circulation amount of the surface treatment solution is desired to be increased, it is only necessary to increase the widths and/or number of the groove channels by cutting the component being used, and therefore, it is unnecessary to use any new component. Accordingly, the present invention is economical.

(5) Since the depth and width of each groove channel can be set with accuracy, the height dimension and width of each gap channel can be set with accuracy. Accordingly, the functions of the gap channels can be properly achieved, and therefore, the circulation amount of the surface treatment solution can be set with accuracy.

In the above-described structure (i), only the surface treatment solution can be circulated from the inside of the treatment cell to the outside thereof through the gap channels. Accordingly, a surface treatment can be performed on the small objects.

Further, in the case where the electrode ring has a multilayer structure, the thin plate members are provided between electrode ring layers; thus, since the gap channels are formed between the electrode ring layers, the number of the gap channels can be correspondingly increased with ease, and accordingly, the circulation amount of the surface treatment solution can be easily increased. Furthermore, to the contrary, if the thin plate members are removed arbitrarily from between the bottom plate and the electrode ring, and/or between the electrode ring and the cover, and/or between the electrode ring layers, the number of the gap channels can be correspondingly reduced easily, and accordingly, the circulation amount of the surface treatment solution can be easily reduced. That is, the circulation amount of the surface treatment solution can be easily increased or decreased in a wide range.

Moreover, the thin plate members are not provided between the bottom plate and the electrode ring, but provided between the electrode ring and the cover and/or between the electrode ring layers; thus, the height position of each gap channel can be easily changed. Actually, even if the size and number of the formed gap channels are the same, it is harder for the surface treatment solution to pass through the gap channels located at high positions than to pass through the gap channels located at low positions. Accordingly, the circulation amount of the surface treatment solution can be easily adjusted by changing the height position of each gap channel.

In addition, similarly to the first invention of the present application, the conventional problems can be solved.

In the above-described structure (ii), only the surface treatment solution can be circulated from the inside of the treatment cell to the outside thereof through the gap channels. Accordingly, a surface treatment can be performed on the small objects.

Further, in the case where the electrode ring has a multilayer structure, the groove channels are formed between electrode ring layers; thus, since the gap channels are formed between the electrode ring layers, the number of the gap channels can be correspondingly increased with ease, and accordingly, the circulation amount of the surface treatment solution can be easily increased.

Moreover, the groove channels are not formed between the bottom plate and the electrode ring, but formed between the electrode ring and the cover and/or between the electrode ring layers; thus, the height position of each gap channel can be easily changed. Actually, even if the size and number of the formed gap channels are the same, it is harder for the surface treatment solution to pass through the gap channels located at high positions than to pass through the gap channels located at low positions. Accordingly, the circulation amount of the surface treatment solution can be easily adjusted by changing the height position of each gap channel.

In addition, similarly to the second invention of the present application, the conventional problems can be solved.

In the above-described structure (iii), in the case where the small objects are replaced with ones having larger minimum dimensions, the gap channels having correspondingly appropriate height dimensions can be easily formed.

In the above-described structure (iv), since the cutout portion constitutes a large inlet channel communicated with the gap channels, the collision of the small objects against inlet peripheral edges of the gap channels can be suppressed. Accordingly, the breakage of the small objects can be suppressed.

In the above-described structure (v), since the peripheral edge portion is protuberant, the amount of the small objects contained in the treatment cell can be correspondingly increased. Accordingly, the throughput of the surface treatment can be increased. In addition, since the small objects move along the inclined inner face, it is possible to reduce the impact caused when the small objects collide against an inner circumferential face of the treatment cell. Accordingly, the breakage of the small objects can be suppressed.

Further, since the bottom plate is normally made of resin, the material cost is low, and a working process for making the peripheral edge portion protuberant can be easily performed; in addition, the inclination angle of the peripheral edge portion can be easily changed in accordance with the type of the small objects.

Furthermore, when the treatment cell is rotated, the small objects go up along the inclined inner face of the peripheral edge portion due to a centrifugal force, and when the treatment cell is stopped, the small objects go down along the inclined inner face of the peripheral edge portion due to gravity. That is, if the treatment cell is rotated and stopped repeatedly, the small objects go up and down along the inclined inner face of the peripheral edge portion. Accordingly, by repeatedly rotating and stopping the treatment cell, the agitation of the small objects can be promoted, and a surface treatment can be uniformly performed on the small objects.

In the above-described structure (vi), the width of each gap channel can be easily changed. Accordingly, the circulation amount of the surface treatment solution can be easily adjusted.

In the above-described structure (vii), the working cost can be reduced. Furthermore, the circulation amount of the surface treatment solution can be easily adjusted.

In the above-described structure (viii), since the treatment cell can be detached from the vertical rotation shaft due to the attachment and detachment means, it is possible to easily perform the removal of the small objects within the treatment cell, and/or the disassembly, assembly, cleaning and the like of the treatment cell.

Moreover, in the attachment and detachment means, the convex portion provided at the rotational center of the lower face of the treatment cell is fitted into the concave portion formed at the rotational center of the receiving plate, and therefore, the rotational center of the treatment cell can be accurately positioned with respect to the vertical rotation shaft.

In addition, since the protrusive portions are fitted into a plurality of the hole portions, a rotational force of the vertical rotation shaft can be transmitted to the treatment cell via the receiving plate and the protrusive portions with certainty.

Further, if the convex portion, provided at the rotational center of the lower face of the treatment cell, is fitted into the concave portion, formed at the rotational center of the receiving plate, and the receiving plate is rotated, the protrusive portions of the receiving plate are automatically fitted into the hole portions at the lower face of the treatment cell. Accordingly, when the treatment cell is placed onto the receiving plate, it is only necessary to fit the convex portion into the concave portion without considering the orientation of the treatment cell. Therefore, the treatment cell can be easily placed onto the receiving plate.

BEST MODE FOR CARRYING OUT THE INVENTION

First Embodiment

The present embodiment relates to an apparatus for performing an electroplating process in a surface treatment. It should be noted that the apparatus of the present embodiment is not limited in use to an electroplating process, but can be used to perform a process that requires energization (electric action) in a surface treatment. Examples of such a process include a composite plating process, an anion electrodeposition coating process, a cation electrodeposition coating process, an acid electrolytic process, and an electropolishing process.

Figure 1:
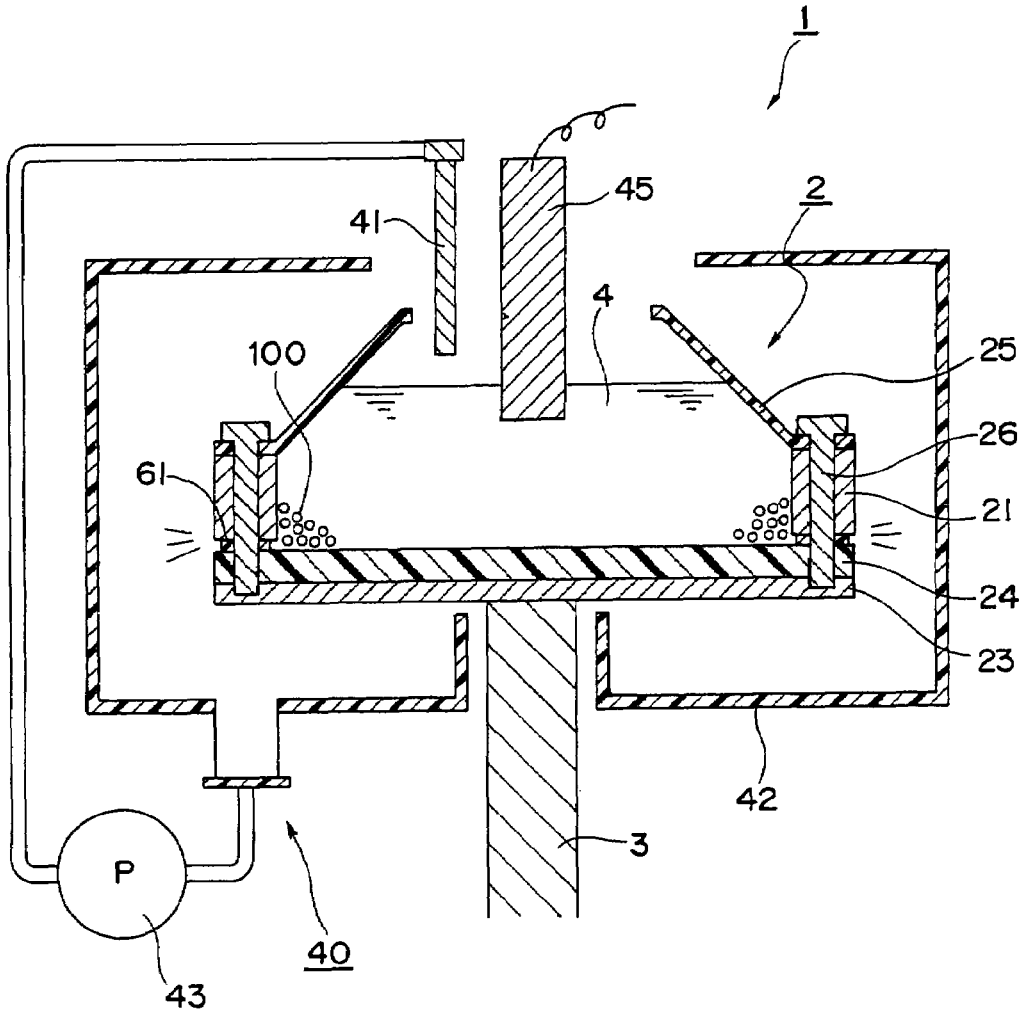
FIG. 1 is a front cross-sectional view showing a plating process apparatus for small objects according to a first embodiment of the present invention.
Figure 2:
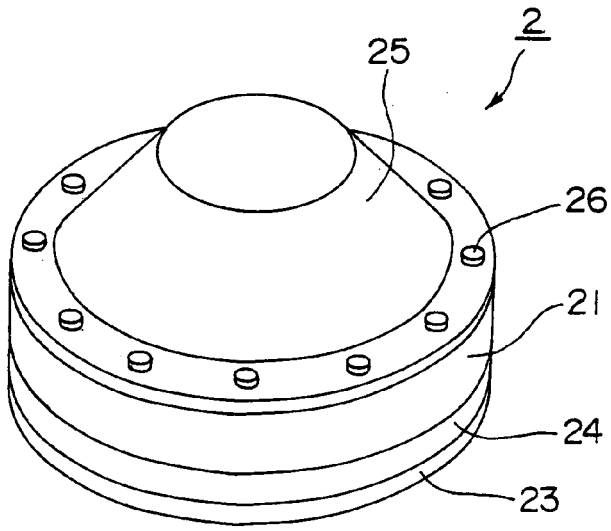
FIG. 2 is a top perspective view of a treatment cell shown in FIG. 1.

FIG. 1 is a front cross-sectional view showing a plating process apparatus for small objects according to the present embodiment. This plating process apparatus 1 includes: a treatment cell 2 that is circular in plan view; a vertical rotation shaft 3 for rotating the treatment cell 2 around the circular center (rotational center) thereof on a horizontal plane; and a cyclic means 40 for a plating solution 4. FIG. 2 is a top perspective view of the treatment cell 2.

The treatment cell 2 is formed by a conductive base plate 23, a nonconductive bottom plate 24, an electrode ring 21 and a cover 25, which are superposed in this order from the bottom and are combined with bolts 26 that pass through the electrode ring 21, and has a flow-out means for flowing out the plating solution 4 from the inside of the treatment cell 2 to the outside thereof. The electrode ring 21 can be energized through the vertical rotation shaft 3, the base plate 23 and the bolts 26. In other words, in the present embodiment, the vertical rotation shaft 3, the base plate 23 and the bolts 26 constitute an energization means for energizing the electrode ring 21. Further, the plating process apparatus 1 is formed so as to energize the plating solution 4 within the treatment cell 2 from an electrode 45 while bringing small objects 100 into contact with the electrode ring 21 and circulating the plating solution 4 from the inside of the treatment cell 2 to the outside thereof through the flow-out means by rotating the treatment cell 2 containing the small objects 100, thereby performing a plating process on the small objects 100. In the plating process apparatus 1, the plating solution 4 is repeatedly used while being cycled by the cyclic means 40. Specifically, the plating solution 4 is discharged from a nozzle 41 to the inside of the treatment cell 2, flowed out and scattered from the treatment cell 2 through the flow-out means, received and collected by a case 42, and discharged from the nozzle 41 by a pump 43.

Figure 3:
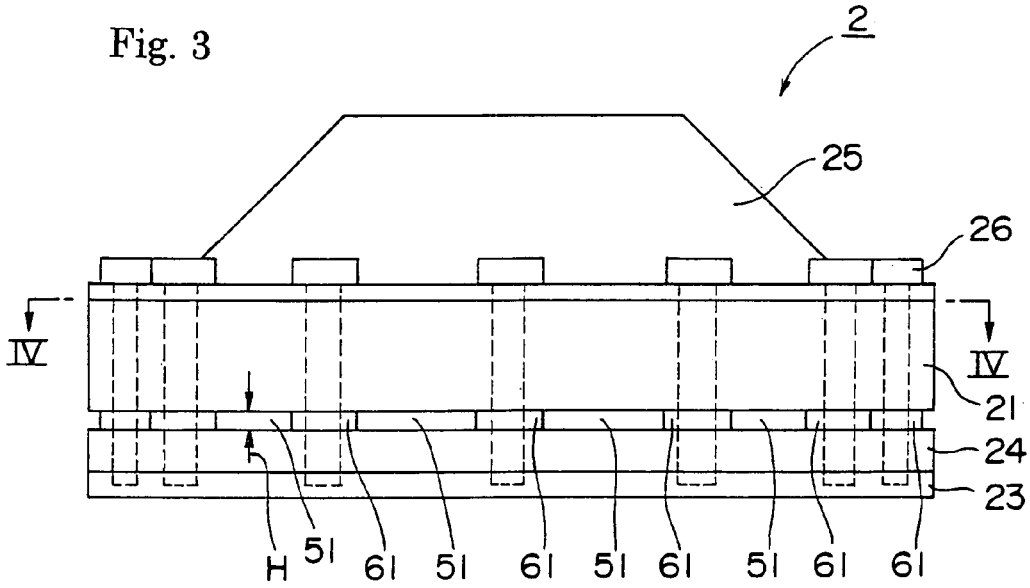
FIG. 3 is a front view of the treatment cell shown in FIG. 1.
Figure 4:
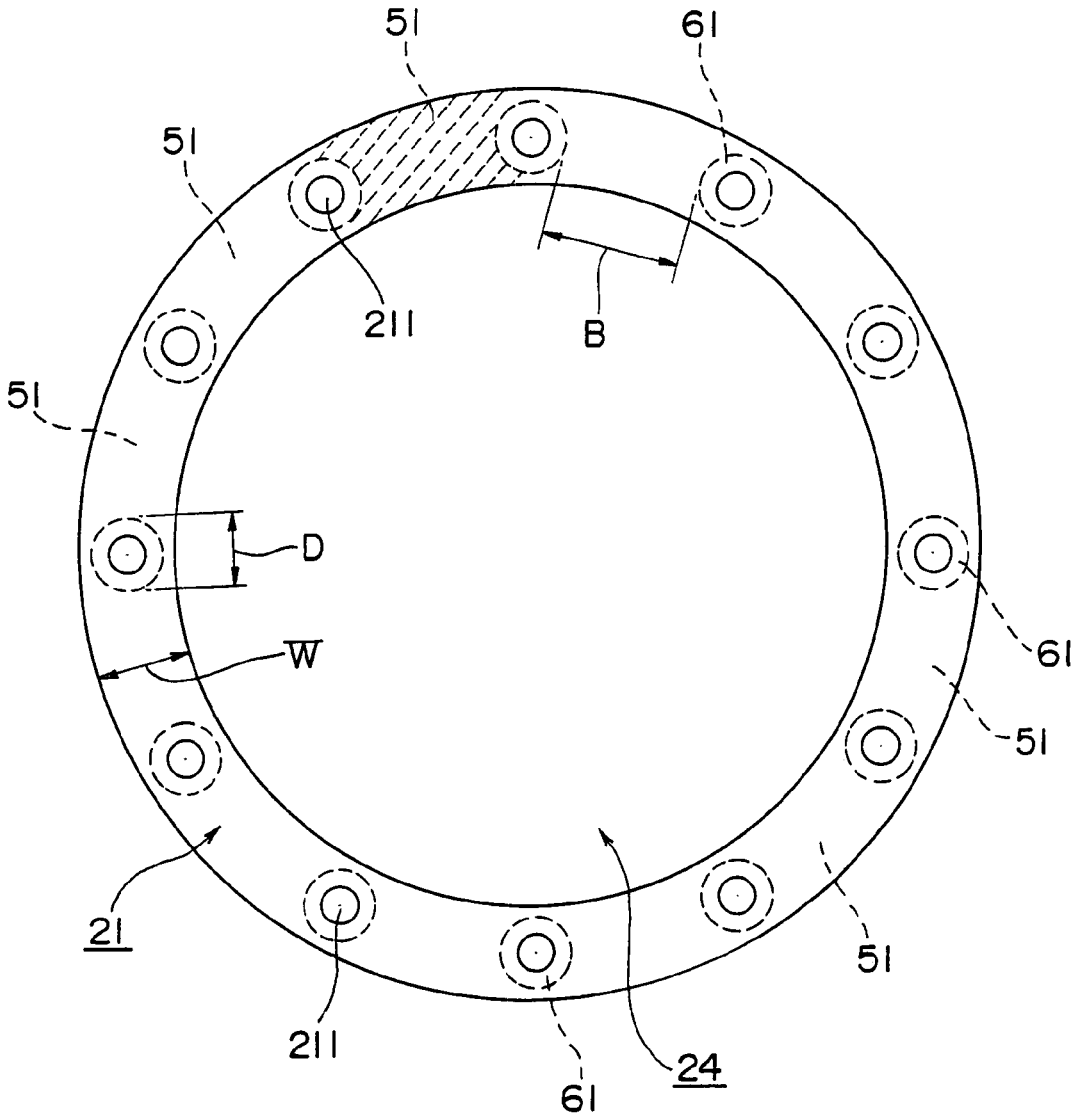
FIG. 4 is a diagram taken along the arrows IV-IV shown in FIG. 3.

FIG. 3 is a front view of the treatment cell 2, and FIG. 4 is a diagram taken along the arrows IV-IV shown in FIG. 3. In the present embodiment, gap channels 51 formed between the bottom plate 24 and the electrode ring 21 are adopted as the flow-out means.

Sheet members 61, made of resin and having the same size, are arranged circumferentially at appropriate intervals between the bottom plate 24 and the electrode ring 21, and the sheet members 61 are sandwiched between the bottom plate 24 and the electrode ring 21, thus forming the gap channels 51 between the adjacent sheet members 61. In FIG. 4, one of the gap channels 51 is indicated by the dashed diagonal lines. In the present embodiment, the twelve sheet members 61 are arranged, and the twelve gap channels 51 are formed.

Figure 5:
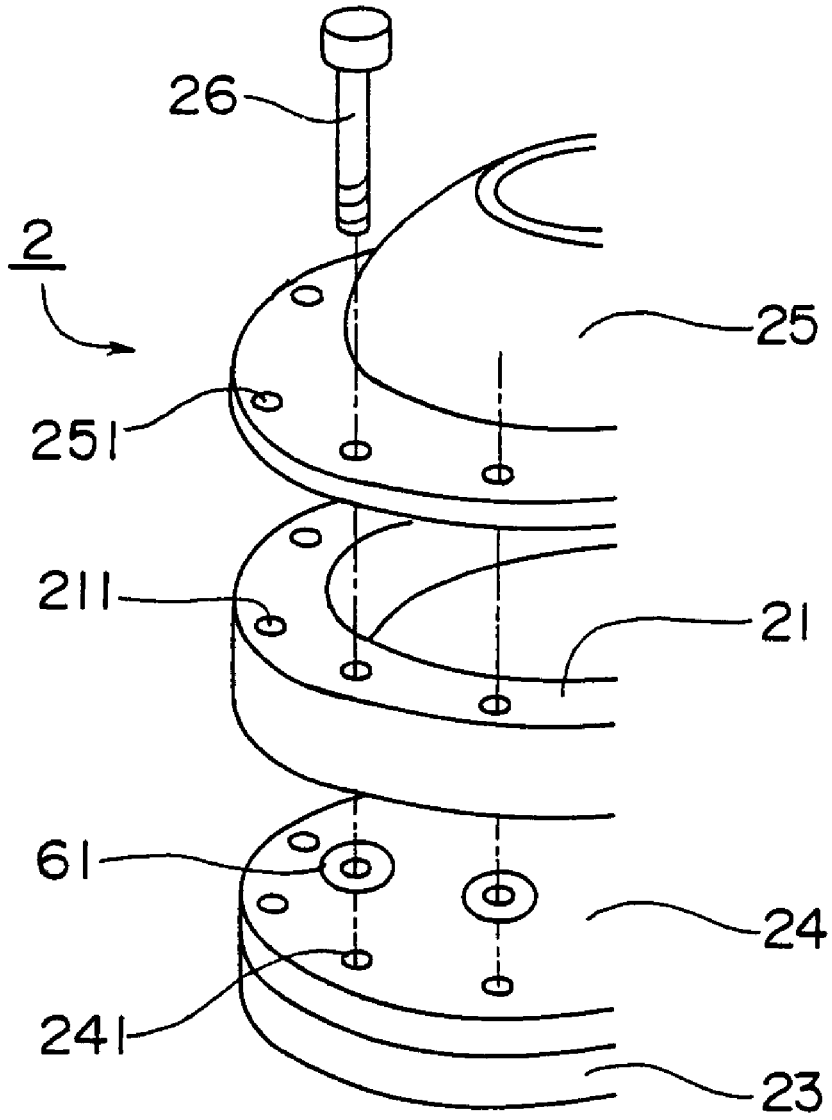
FIG. 5 is a partial perspective view showing how the treatment cell is assembled.

The sheet members 61 each have an annular shape. Further, as shown in FIG. 4, in the electrode ring 21, the sheet members 61 are arranged so as to surround through holes 211 for the bolts 26, and as shown in FIG. 5, the bottom plate 24, the electrode ring 21 and the cover 25 are superposed to allow the bolts 26 to pass therethrough, thus holding the sheet members 61 between the bottom plate 24 and the electrode ring 21. Furthermore, an outer diameter D (FIG. 4) of each sheet member 61 is equal to or smaller than a ring width W (FIG. 4) of the electrode ring 21. Accordingly, in plan view, the sheet members 61 are not protruded from the electrode ring 21 into the inside of the treatment cell 2.

A height dimension H (FIG. 3) of each gap channel 51 is equal to the thickness of each sheet member 61. Further, the thickness of each sheet member 61 is set to be smaller than the minimum dimension of each small object 100. Accordingly, the height dimension H of each gap channel 51 is smaller than the minimum dimension of each small object 100.

It should be noted that, specifically, the sheet members 61 are formed by punching out a sheet, made of fluorine-contained resin such as PTFE, PFA or FEP, into a desired shape with a punch. The sheet made of such fluorine-contained resin is suitable for the sheet members 61 because it has the following properties (i) through (iii):

(i) It will not be thicken due to thermal expansion. Furthermore, it will not be thinned even when pressed from both sides.

(ii) It will not react with a plating solution.

(iii) It will not be damaged even if a mechanical stress exceeding the disruptive strength of this material is applied.

In the plating process apparatus 1 having the above-described structure, the plating solution 4 within the treatment cell 2 flows out through the gap channels 51 due to a centrifugal force caused by the rotation of the treatment cell 2. On the other-hand, since the height dimension H of each gap channel 51 is smaller than the minimum dimension of each small object 100, the gap channels 51 do not allow the small objects 100 to pass therethrough. Accordingly, the gap channels 51 each function as a filter that prevents the small objects 100 from passing therethrough but allows the plating solution 4 to pass therethrough. Therefore, the plating process apparatus 1 having the above-described structure can plate the small objects 100 without losing the small objects 100, and enables the cyclic use of the plating solution 4.

Furthermore, the plating process apparatus 1 of the present embodiment can solve the conventional problems as described below.

(1) Since a conventional porous ring made of sintered resin is not used, the breakage of the small objects 100 due to the collision thereof against the surface irregularities of the porous ring can be completely prevented. It should be noted that the small objects 100 might collide against inner inlet edges of the gap channels 51, whereas the impact applied to the small objects 100 due to this collision is believed to be extremely smaller than the case where the small objects 100 collide against the surface irregularities of the porous ring. Accordingly, the breakage of the small objects 100 can be suppressed.

(2) Since the breakage of the small objects 100 can be suppressed, the clogging of the gap channels 51 by broken pieces of the small objects 100 can be suppressed. In addition, the structure of the gap channels 51 is not as complicated as that of openings of a conventional porous ring, and therefore, the clogging is unlikely to occur. Accordingly, it is possible to suppress the unfavorable performance of a plating process resulting from the clogging of the gap channels 51.

Moreover, even if broken pieces of the small objects 100, broken pieces of the electrode, or dusts in air, for example, have clogged the gap channels 51, the treatment cell 2 can be easily disassembled and cleaned by detaching the bolts 26, and therefore, the clogging can be easily removed. Furthermore, since the treatment cell 2 can be used over and over by easily removing the clogging thereof, it does not have to be replaced with a new one unlike a conventional porous ring, and therefore, cost reduction can be achieved.

(3) Since a conventional porous ring made of sintered resin is not used, a cutting work operation for sintered resin is unnecessary. Accordingly, a reduction in the function of the flow-out means due to the heat generated during a cutting work never occurs in the present embodiment.

Figure 6:
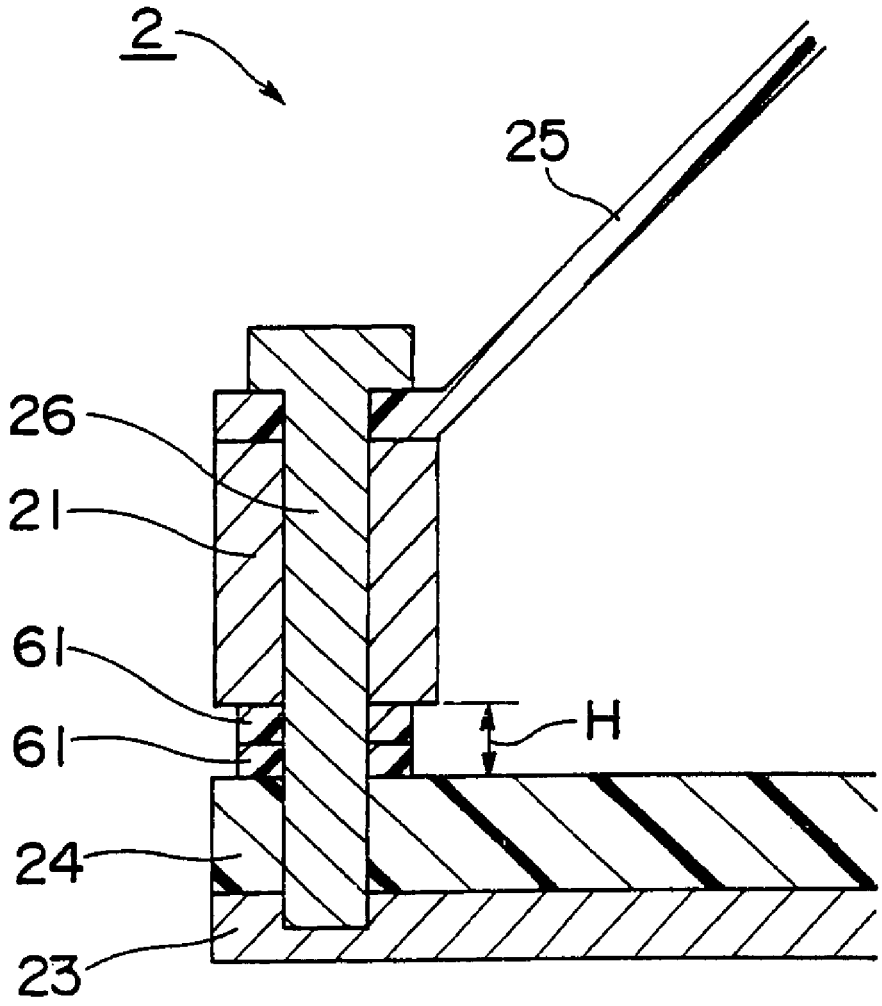
FIG. 6 is a partial front cross-sectional view showing a treatment cell having a first exemplary modified structure of the first embodiment.

(4) If the small objects 100 are replaced with ones having smaller minimum dimensions, the height dimension H of each gap channel 51 must be set to be smaller; however, in that case, it is only necessary to replace the sheet members 61 with thinner ones. On the other hand, if the small objects 100 are replaced with ones having larger minimum dimensions, the height dimension H of each gap channel 51 is preferably set to be greater; however, in that case, it is only necessary to replace the sheet members 61 with thicker ones. It is easy to prepare the sheet members 61 having various thicknesses. Accordingly, even if the small objects 100 are replaced with ones having different dimensions, the gap channels 51 having correspondingly appropriate height dimensions H can be formed easily and economically. It should be noted that, in order to set the height dimension H of each gap channel 51 to be greater, a plurality of the sheet members 61 may be stacked as shown in FIG. 6, although detailed description will be made about this later.

Further, if the circulation amount of the plating solution 4 per unit time (which will hereinafter be simply called a "circulation amount") is desired to be adjusted, it is only necessary to change a width B of each gap channel 51, i.e., a distance B between the adjacent sheet members 61 (FIG. 4), and for this purpose, it is only necessary to change the outer diameter D of each sheet member 61. It is easy to prepare the sheet members 61 having the various outer diameters D. Accordingly, the circulation amount of the plating solution 4 can be adjusted easily and economically. It should be noted that, in order to adjust the circulation amount of the plating solution 4, the structures shown in FIG. 7 through FIG. 10 may alternatively be adopted, although detailed description will be made about this later.

(5) Since the thickness and the outer diameter D of each sheet member 61 can be set with accuracy, the height H and width B of each gap channel 51 can be set with accuracy. Accordingly, the functions of the gap channels 51 can be properly achieved, and therefore, the circulation amount of the plating solution 4 can be set with accuracy.

Moreover, the plating process apparatus 1 of the present embodiment can achieve the following effects:

(1) Since the sheet members 61 are made of resin, the cost is low.

(2) Since the sheet members 61 are made of resin, the plating is unlikely to be attached. Accordingly, the operation of removing the plating attached to an inner face of the treatment cell 2 can be simplified.

(3) Since the annular sheet members 61 are arranged to surround the through holes 211 for the bolts 26, the plating solution 4 will not be brought into contact with the bolts 26. Accordingly, the plating can be prevented from being attached to the bolts 26. Therefore, the operation of removing the plating can be simplified similarly to the above-mentioned effect (2).

(4) Since the outer shape of each sheet member 61 is circular, the size of each gap channel 51 between the adjacent sheet members 61 can be kept constant even if the sheet members 61 are arranged to face any direction. Accordingly, the functions of the gap channels 51 can be properly achieved.

(5) Since the outer diameter D of each sheet member 61 is equal to or smaller than the ring width W of the electrode ring 21, the sheet members 61 will not protrude into the inside of the treatment cell 2. If the sheet members 61 are protruded, the small objects 100 collide against the protruded portions, which is feared to cause the breakage of the small objects 100 and/or cause troubles in performing a plating process on the small objects 100; however, in the present embodiment, such fears can be dispelled because the sheet members 61 are not protruded.

It should be noted that, in the present embodiment, the following modified structures may further be adopted.

(1) The two or more sheet members 61 are provided so as to be stacked. For example, the two sheet members 61 are provided so as to be stacked as shown in FIG. 6. In such a structure, the height dimension H of each gap channel 51 can be easily increased. Accordingly, in the case where the small objects 100 are replaced with ones having larger minimum dimensions, the gap channels 51 having correspondingly appropriate height dimensions H can be easily formed.

Figure 7:
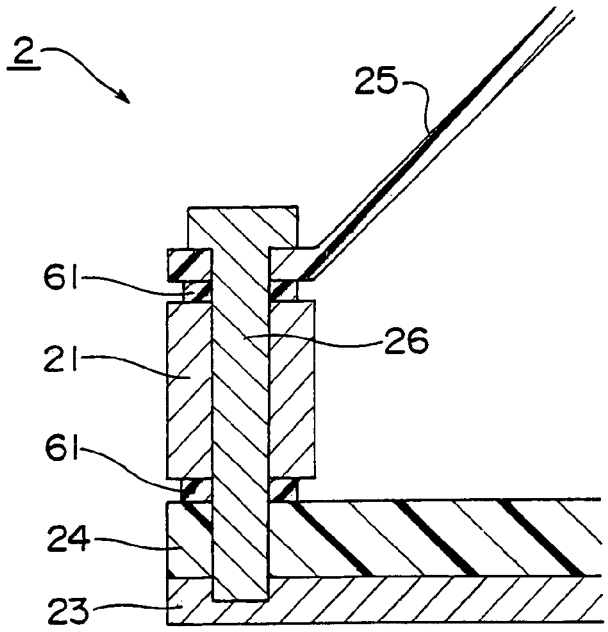
FIG. 7 is a partial front cross-sectional view showing a treatment cell having a second exemplary modified structure of the first embodiment.
Figure 8:
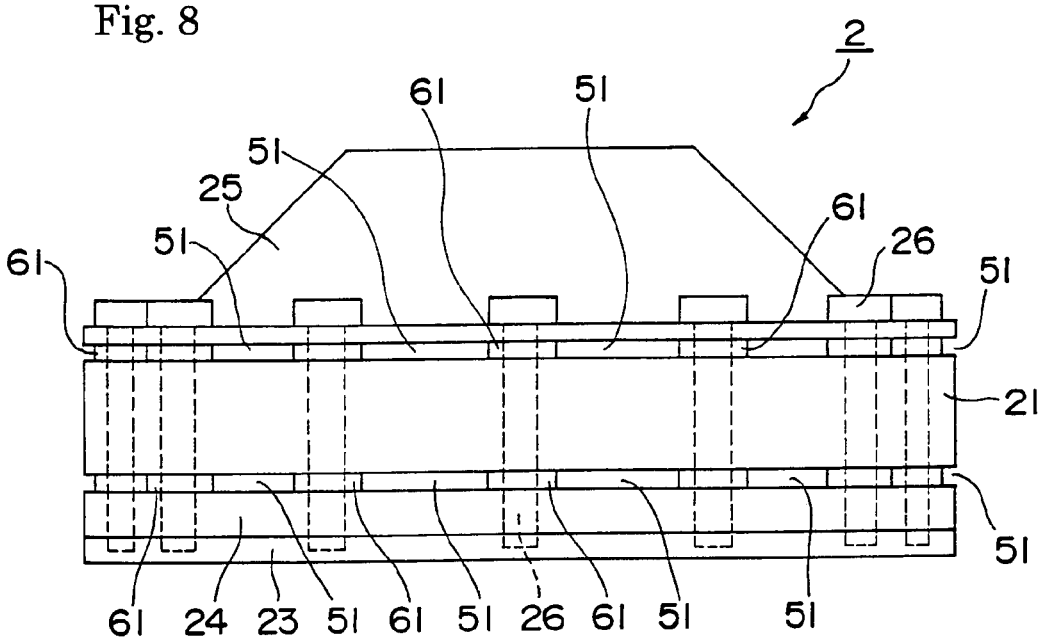
FIG. 8 is a front view of the treatment cell according to the example shown in FIG. 7.

(2) As shown in FIG. 7 and FIG. 8, the sheet members 61 are provided not only between the bottom plate 24 and the electrode ring 21, but also between the electrode ring 21 and the cover 25. In such a structure, compared with the present embodiment, the number of the gap channels 51 can be easily increased, and accordingly, the circulation amount of the plating solution 4 can be easily increased.

Figure 9:
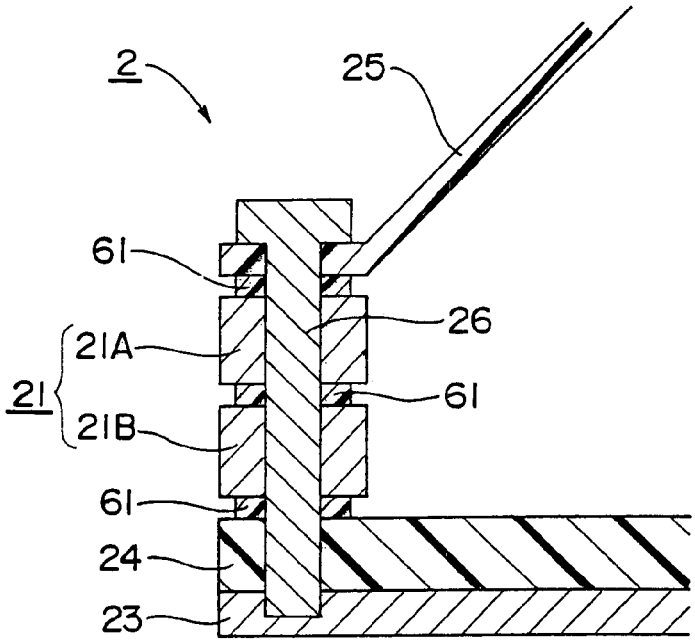
FIG. 9 is a partial front cross-sectional view showing a treatment cell having a third exemplary modified structure of the first embodiment.
Figure 10:
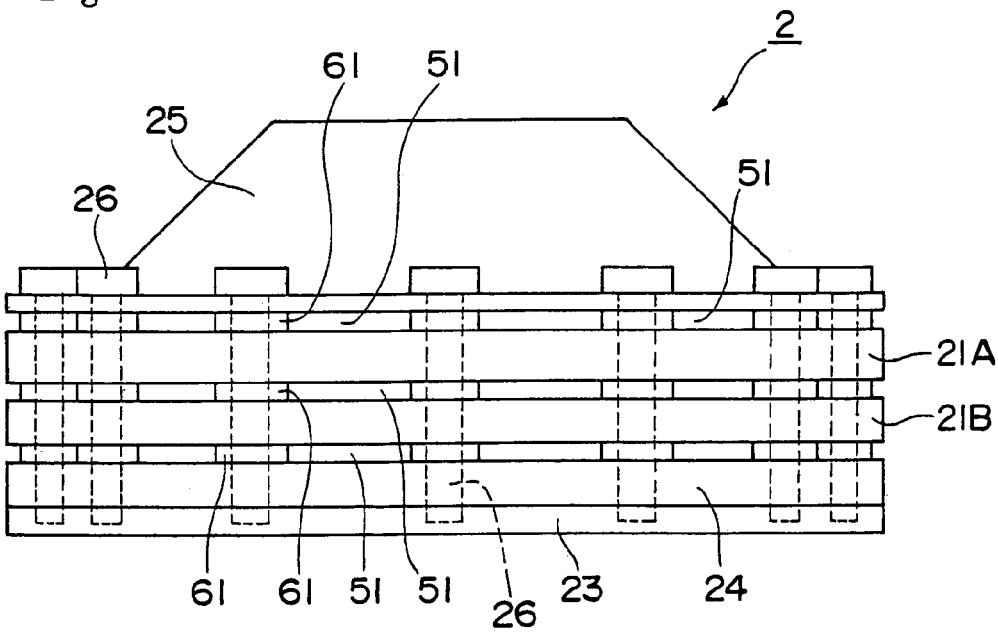
FIG. 10 is a front view of the treatment cell according to the example shown in FIG. 9.

(3) In the case where the electrode ring 21 has a multilayer structure, the sheet members 61 are provided between electrode ring layers. In such a structure, since the gap channels 51 are formed between the electrode ring layers, the number of the gap channels 51 can be correspondingly increased with ease, and accordingly, the circulation amount of the plating solution 4 can be easily increased. For example, in the case where the electrode ring 21 has a two-layer structure as shown in FIG. 9 and FIG. 10, the sheet members 61 are provided between the bottom plate 24 and the electrode ring 21, between the electrode ring 21 and the cover 25, and between an electrode ring layer 21A and an electrode ring layer 21B. In such a structure, compared with the above-mentioned modified structure (2), the number of the gap channels 51 can be easily increased.

Furthermore, to the contrary, if the sheet members 61 are removed arbitrarily from between the bottom plate 24 and the electrode ring 21, and/or between the electrode ring 21 and the cover 25, and/or between the electrode ring layers, the number of the gap channels 51 can be correspondingly reduced easily, and accordingly, the circulation amount of the plating solution 4 can be easily reduced.

That is, the circulation amount of the plating solution 4 can be easily increased or decreased in a wide range.

(4) The sheet members 61 are not provided between the bottom plate 24 and the electrode ring 21, but provided between the electrode ring 21 and the cover 25 and/or between the electrode ring layers. In such a structure, the height position of each gap channel 51 can be easily changed. Even if the size and number of the formed gap channels 51 are the same, it is harder for the plating solution 4 to pass through the gap channels 51 located at high positions than to pass through the gap channels 51 located at low positions. Accordingly, the circulation amount of the plating solution 4 can be easily adjusted by changing the height position of each gap channel 51.

Figure 11:
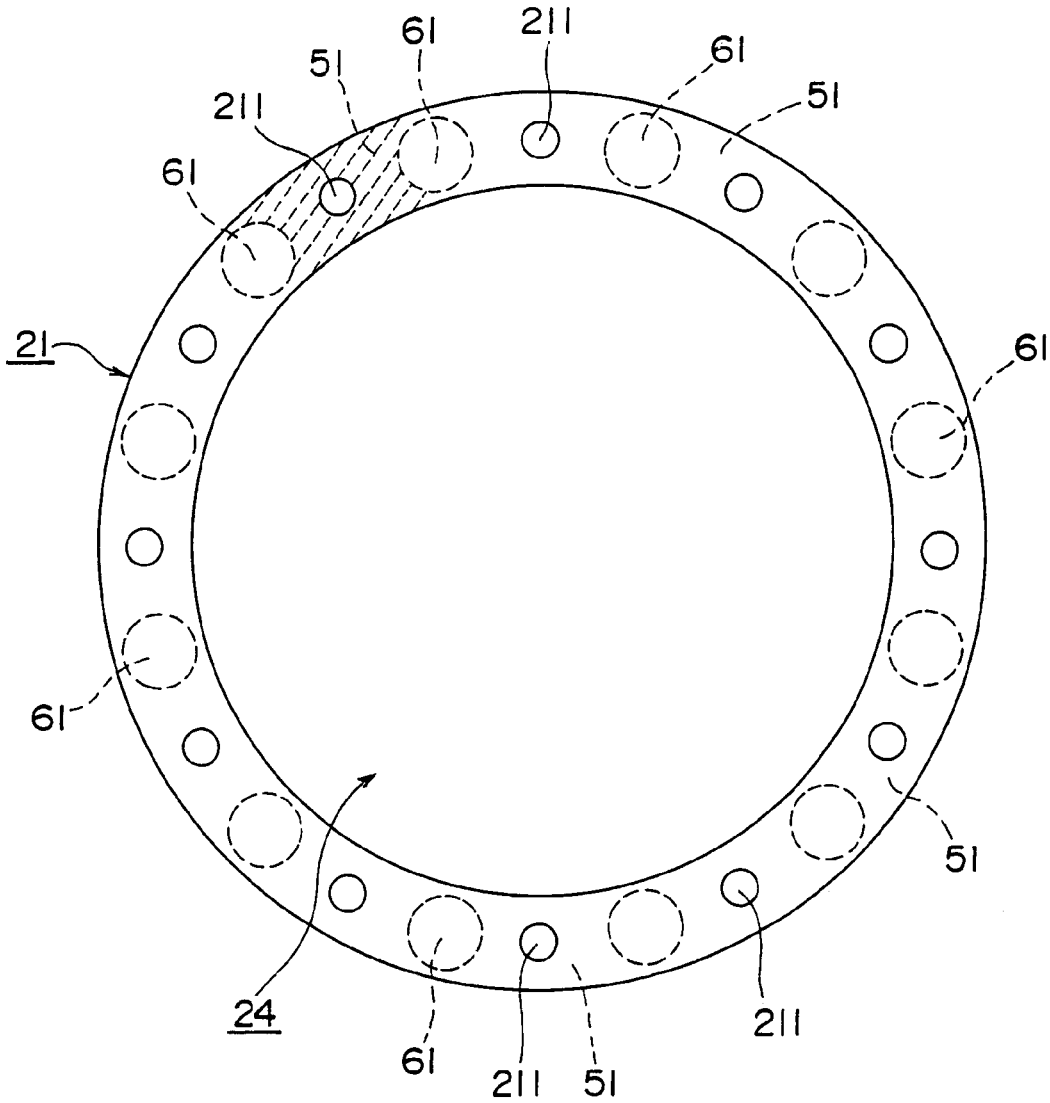
FIG. 11 is a diagram showing a fifth exemplary modified structure of the first embodiment, which is equivalent to FIG. 4.

(5) As shown in FIG. 11 equivalent to FIG. 4, the sheet members 61 are provided between the adjacent through holes 211. Also in such a structure, the gap channels 51 are formed between the adjacent sheet members 61. In such a structure, it is unnecessary to pass the bolts 26 through the sheet members 61, and therefore, the treatment cell 2 can be easily assembled. It should be noted that, also in FIG. 11, one of the gap channels 51 is indicated by the dashed diagonal lines.

Figure 12:
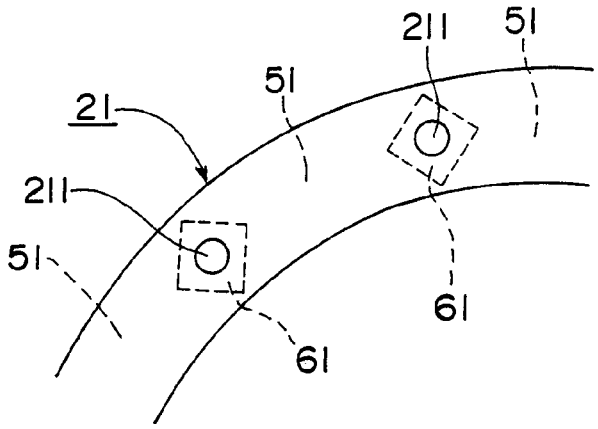
FIG. 12 is a diagram showing a sixth exemplary modified structure of the first embodiment, which is equivalent to FIG. 4.

(6) As shown in FIG. 12 equivalent to FIG. 4, rectangular sheet members 61 are used. Also in such a structure, the gap channels 51 are formed between the adjacent sheet members 61.

(7) The sheet members 61 made of metal are used. For example, titanium and/or stainless steel may be used as the metal. In such a structure, the working accuracy for the sheet members 61 is improved, and therefore, the gap channels 51 having more accurate sizes can be formed.

Figure 13:
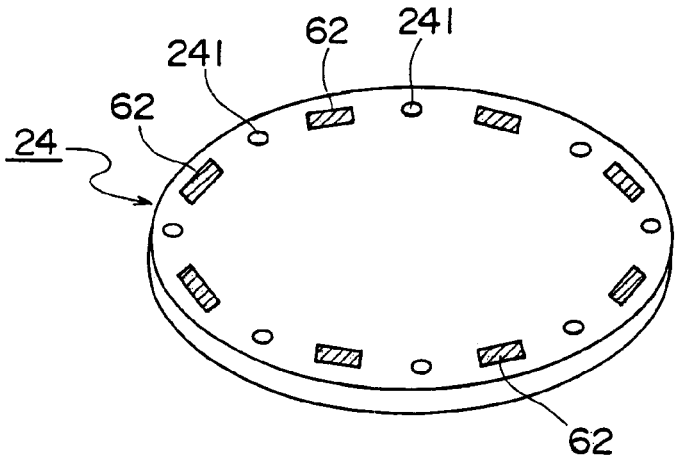
FIG. 13 is a top perspective view of a bottom plate having an eighth exemplary modified structure of the first embodiment.
Figure 14:
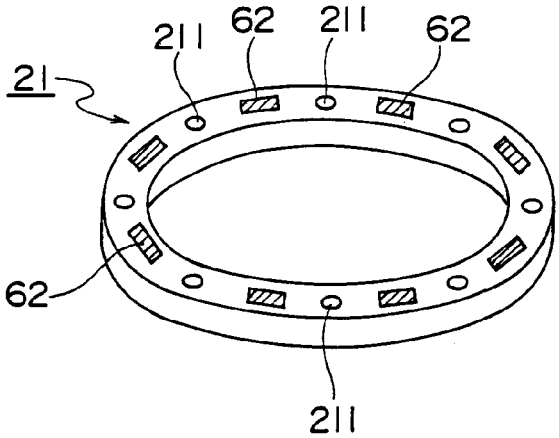
FIG. 14 is a top perspective view of an electrode ring having an eighth exemplary modified structure of the first embodiment.

(8) Instead of the sheet members 61, adhesive tape members 62 are used. For example, as shown in FIG. 13, the adhesive tape members 62 are adhered between adjacent through holes 241 of the bottom plate 24. Alternatively, as shown in FIG. 14, the adhesive tape members 62 are adhered between the adjacent through holes 211 of the electrode ring 21. Furthermore, similarly to the case shown in FIG. 4, the adhesive tape members 62 are adhered so as to surround the through holes 211 or the through holes 241. It should be noted that polyimide and/or polyester are/is preferable as the material(s) for the adhesive tape members 62. Also in such a structure, the gap channels 51 can be formed similarly to the case where the sheet members 61 are used. In addition, in such a structure, the treatment cell 2 can be easily assembled, thus enabling a cost reduction.

(9) In the case where the electrode ring 21 has a multilayer structure, the electrode ring layer(s) except any one of the electrode ring layers is/are made of resin. In such a structure, the working cost and material cost can be reduced. It should be noted that, even in such a structure, a plating process is performed because at least one of the electrode ring layers is conductive.

(10) The sheet members 61 are arranged circumferentially not at regular intervals but at appropriate intervals. In such a structure, the treatment cell 2 can be easily assembled, thus enabling cost reduction.

(11) The sheet members 61 having different sizes are arranged. In such a structure, it is possible to easily produce the sheet members 61 without concerning about accurate dimensions, thus enabling a reduction in the material cost.

(12) An arbitrary number of the sheet members 61 are provided. In such a structure, the number of the gap channels 51 can be easily changed. Accordingly, the circulation amount of the plating solution 4 can be easily adjusted.

Figure 15:
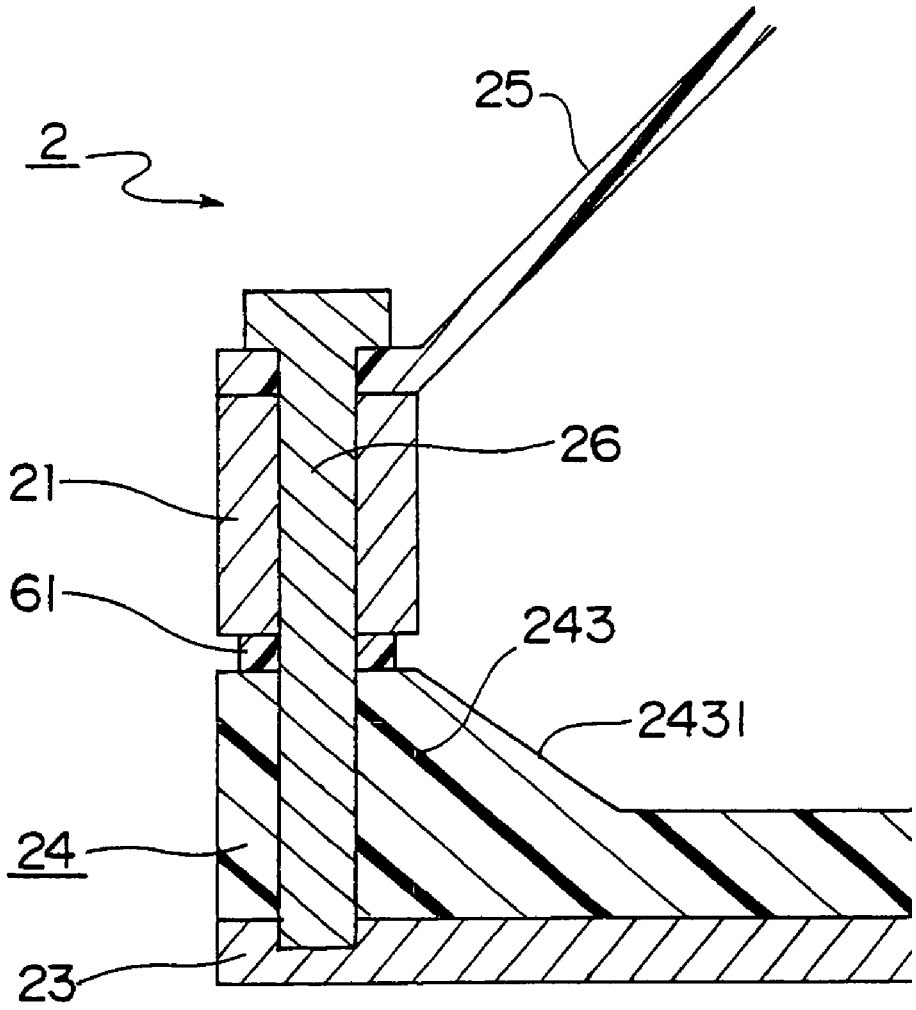
FIG. 15 is a partial front cross-sectional view showing a treatment cell having a thirteenth exemplary modified structure of the first embodiment.

(13) As shown in FIG. 15, a peripheral edge portion 243 of the bottom plate 24 is formed so as to be protuberant. An inner face 2431 of the peripheral edge portion 243 is inclined downward and inward. In such a structure, the following effects can be achieved:

(i) Since the peripheral edge portion 243 of the bottom plate 24 is protuberant, the amount of the small objects 100 contained in the treatment cell 2 can be correspondingly increased. Accordingly, the throughput of the plating process can be increased.

(ii) Since the inner face 2431 of the protuberant peripheral edge portion 243 of the bottom plate 24 is inclined downward and inward, it is easy to allow the small objects 100 to reach the electrode ring 21. Accordingly, the efficiency of the plating process can be improved. In addition, since the small objects 100 move along the inclined inner face 2431, it is possible to reduce the impact caused when the small objects 100 collide against the electrode ring 21. Accordingly, the breakage of the small objects 100 can be suppressed.

(iii) Since the bottom plate 24 is made of resin, the material cost is low, and a working process for making the peripheral edge portion 243 protuberant can be easily performed; in addition, the inclination angle of the peripheral edge portion 243 can be easily changed in accordance with the type of the small objects 100.

(iv) Since the inclination is formed on the nonconductive bottom plate 24, the change and/or concentration of the current distribution due to the inclination can be prevented.

(v) When the treatment cell 2 is rotated, the small objects 100 go up along the inner face 2431 due to a centrifugal force, and when the treatment cell 2 is stopped, the small objects 100 go down along the inner face 2431 due to gravity. That is, if the treatment cell 2 is rotated and stopped repeatedly, the small objects 100 go up and down along the inner face 2431. Accordingly, by repeatedly rotating and stopping the treatment cell 2, the agitation of the small objects 100 can be promoted, and a plating process can be uniformly performed on the small objects 100.

Figure 16:
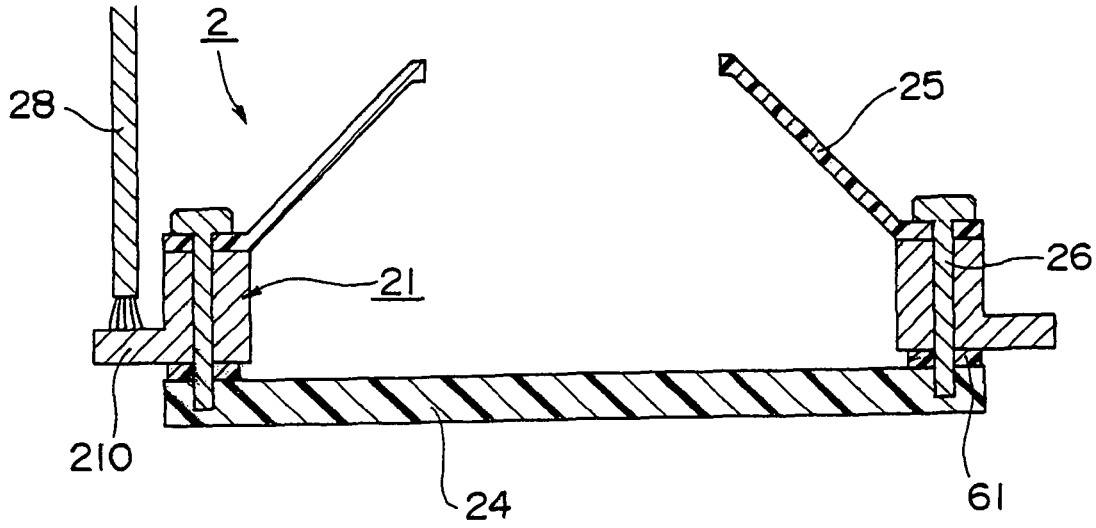
FIG. 16 is a front cross-sectional view showing a treatment cell having a fourteenth exemplary modified structure of the first embodiment.

(14) As shown in FIG. 16, an feed brush 28 is provided so as to be in direct contact with the electrode ring 21, thus forming an energization means. In this structure, the electrode ring 21 has an outer flange 210, and the feed brush 28 is in contact with the outer flange 210 from above. In such a structure, since the energization means can be simplified, the structure of the treatment cell 2 itself can also be simplified. It should be noted that the bottom plate 24 may have the protuberant peripheral edge portion 243.

Figure 17:
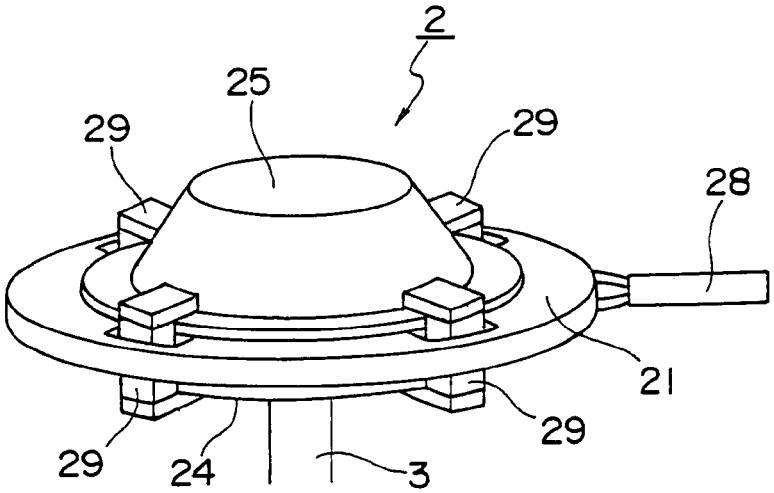
FIG. 17 is a top perspective view showing a treatment cell having a fifteenth exemplary modified structure of the first embodiment.
Figure 18:
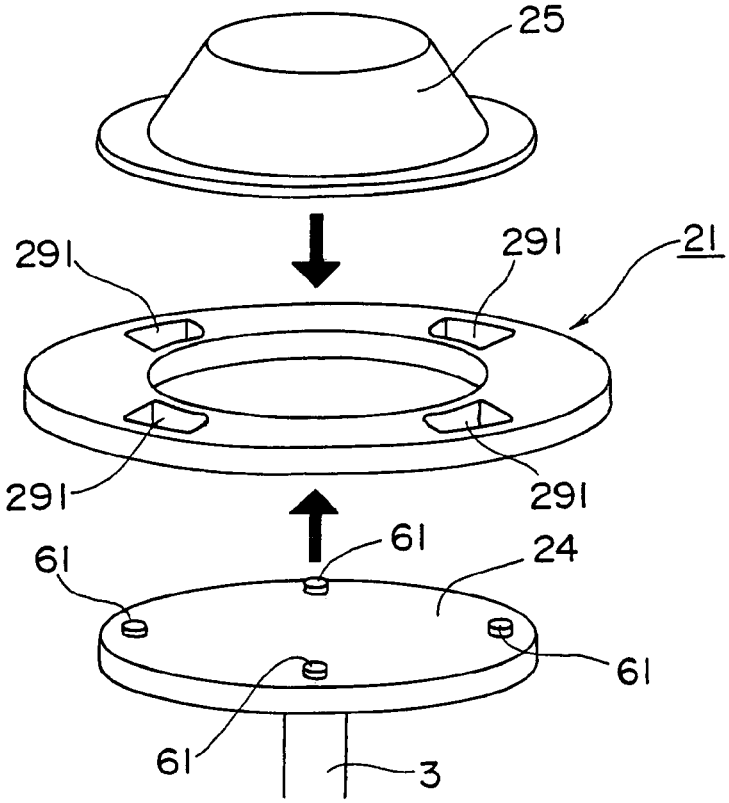
FIG. 18 is an exploded view of the treatment cell shown in FIG. 17.

(15) As shown in FIG. 17, the feed brush 28 is provided so as to be in direct contact with the electrode ring 21 laterally, thus forming an energization means. Also in such a structure, since the energization means can be simplified, the structure of the treatment cell 2 itself can also be simplified. It should be noted that, in the example shown in FIG. 17, the bottom plate 24, the electrode ring 21 and the cover 25 are combined using clamps 29 instead of bolts. FIG. 18 is an exploded view of the example shown in FIG. 17. As shown in FIG. 18, through holes 291, through which the clamps 29 pass, are formed in the electrode ring 21.

(16) The sheet members 61 are provided so as to be located distant from an inner circumferential face of the treatment cell 2. In such a structure, since a large inlet channel, communicated with the gap channels 51, is formed at the inner circumferential face of the treatment cell 2, the collision of the small objects 100 against the inlet peripheral edges of the gap channels 51 can be suppressed, and accordingly, the breakage of the small objects 100 can be suppressed.

Second Embodiment

The present embodiment relates to an apparatus for performing an electroplating process in a surface treatment. It should be noted that the apparatus of the present embodiment is not limited in use to an electroplating process, but can be used to perform a process that requires energization in a surface treatment. Examples of such a process include a composite plating process, an anion electrodeposition coating process, a cation electrodeposition coating process, an acid electrolytic process, and an electropolishing process.

Figure 19:
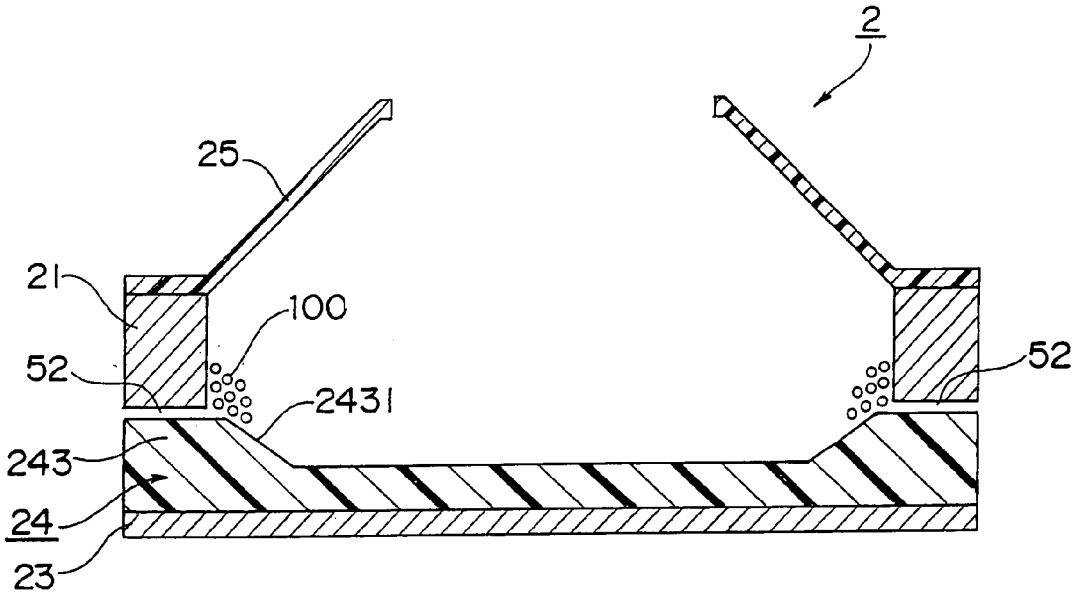
FIG. 19 is a front cross-sectional view showing a treatment cell of a plating process apparatus for small objects according to a second embodiment of the present invention.
Figure 20:
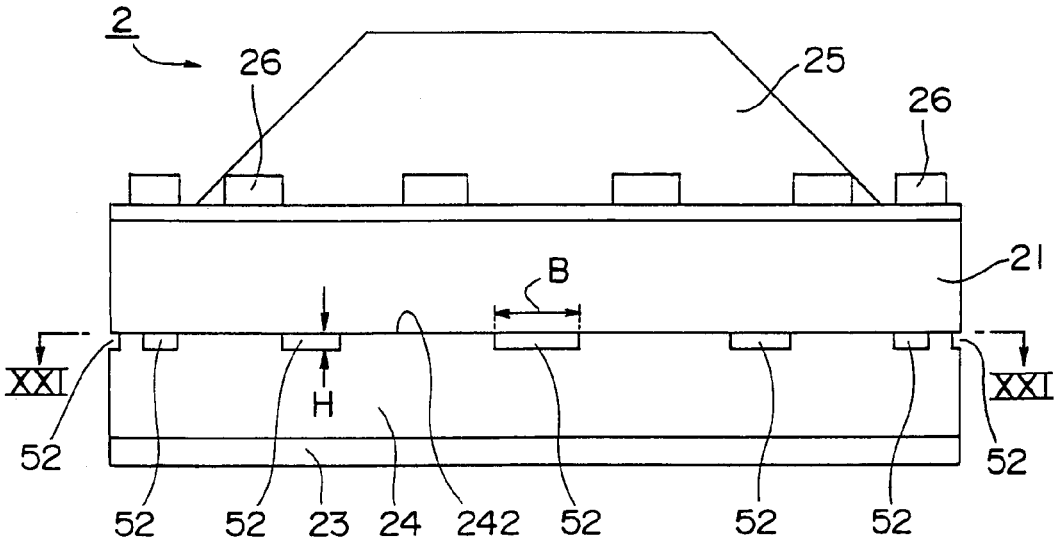
FIG. 20 is a front view of the treatment cell shown in FIG. 19.
Figure 21:
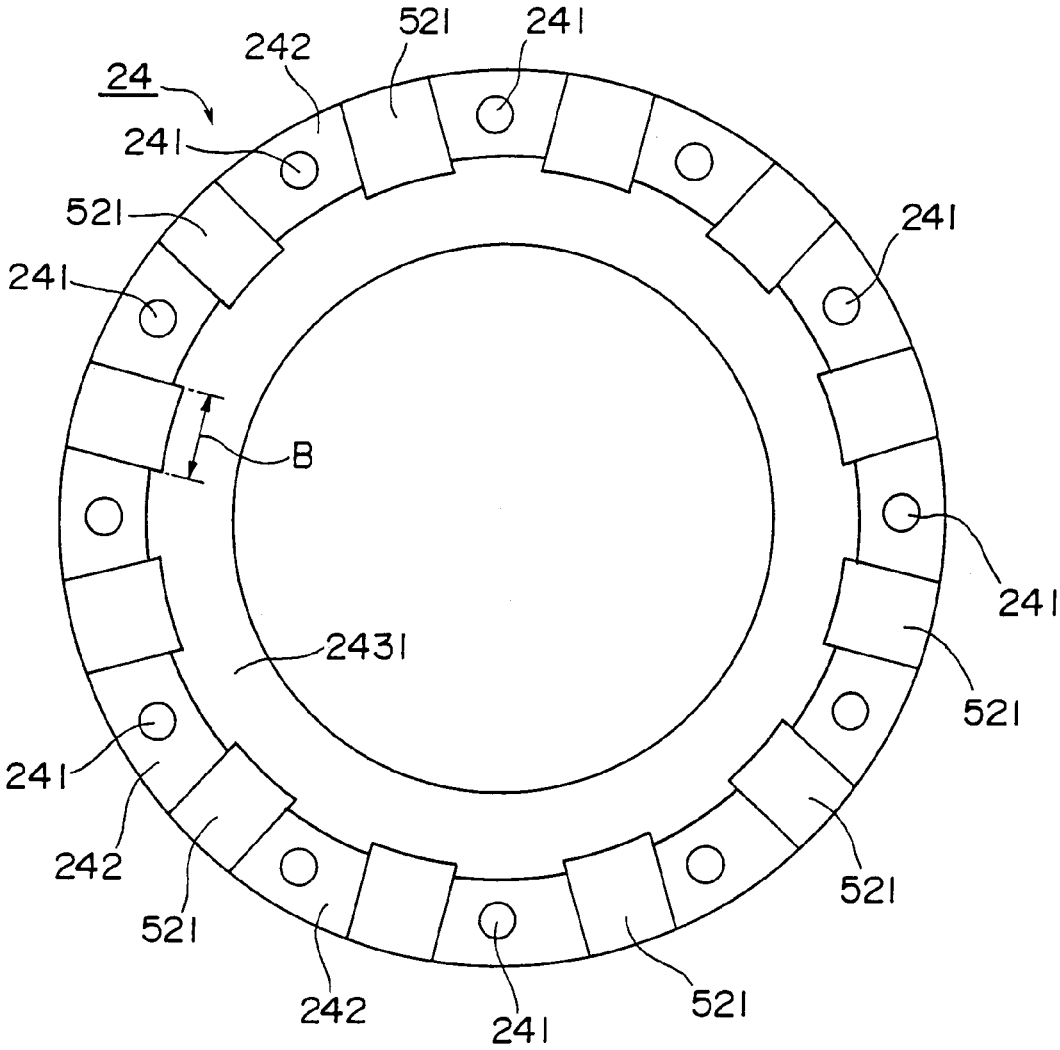
FIG. 21 is a diagram taken along the arrows XXI-XXI shown in FIG. 20.
Figure 22:
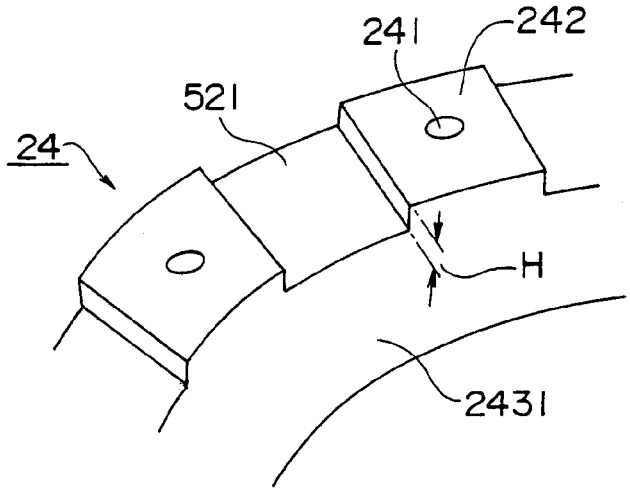
FIG. 22 is a partial top perspective view of FIG. 21.

FIG. 19 is a front cross-sectional view showing a treatment cell of a plating process apparatus for small objects according to the second embodiment of the present invention, FIG. 20 is a front view of the treatment cell, FIG. 21 is a diagram taken along the arrows XXI-XXI shown in FIG. 20, and FIG. 22 is a partial top perspective view of FIG. 21. In the plating process apparatus 1 of the present embodiment, gap channels 52 consisting of groove channels 521 formed at an abutment face 242 of a bottom plate 24, which abuts against an electrode ring 21, are adopted as a flow-out means of the treatment cell 2. The present embodiment is similar to the first embodiment in other structures.

In the present embodiment, a peripheral edge portion 243 of the bottom plate 24 is protuberant, and the abutment face 242 serves as an upper face of the peripheral edge portion 243. Further, an inner face 2431 of the peripheral edge portion 243 is inclined downward and inward.

In the bottom plate 24, the groove channels 521 with the same size are formed between adjacent through holes 241 and arranged circumferentially at regular intervals. The groove channels 521 are formed so as to traverse the upper face of the peripheral edge portion 243 of the bottom plate 24 from inside to outside. Accordingly, in the state where the electrode ring 21 is superposed on the bottom plate 24, the groove channels 521 constitute the gap channels 52 that pass through the treatment cell 2 from inside to outside.

The height dimension H (FIG. 20) of each gap channel 52 is equal to the depth of each groove channel 521. Further, the depth H of each groove channel 521 is set to be smaller than the minimum dimension of each small object 100. Accordingly, the height dimension H of each gap channel 52 is smaller than the minimum dimension of each small object 100.

The groove channels 521 can be formed by milling using a milling cutter, for example.

In the plating process apparatus 1 having the above-described structure, a plating solution 4 within the treatment cell 2 flows out through the gap channels 52 due to a centrifugal force caused by the rotation of the treatment cell 2. On the other hand, since the height dimension H of each gap channel 52 is smaller than the minimum dimension of each small object 100, the gap channels 52 do not allow the small objects 100 to pass therethrough. Accordingly, the gap channels 52 each function as a filter that prevents the small objects 100 from passing therethrough but allows the plating solution 4 to pass therethrough. Therefore, the plating process apparatus 1 having the above-described structure can perform a plating process on the small objects 100 without losing the small objects 100, and enables the cyclic use of the plating solution 4.

Furthermore, the plating process apparatus 1 of the present embodiment can solve the conventional problems as described below.

(1) Since a conventional porous ring made of sintered resin is not used, the breakage of the small objects 100 due to the collision thereof against the surface irregularities of the porous ring can be completely prevented. It should be noted that the small objects 100 might collide against inner inlet edges of the gap channels 52, whereas the impact applied to the small objects 100 due to the collision is believed to be extremely smaller than the case where the small objects 100 collide against the surface irregularities of the porous ring. Accordingly, the breakage of the small objects 100 can be suppressed.

(2) Since the breakage of the small objects 100 can be suppressed, the clogging of the gap channels 52 by broken pieces of the small objects 100 can be suppressed. In addition, the structure of the gap channels 52 is not as complicated as that of openings of a conventional porous ring, and therefore, the clogging is unlikely to occur. Accordingly, it is possible to suppress the unfavorable performance of a plating process resulting from the clogging of the gap channels 52.

Moreover, even if broken pieces of the small objects 100, broken pieces of the electrode, or dusts in air, for example, have clogged the gap channels 52, the treatment cell 2 can be easily disassembled and cleaned by detaching bolts 26, and therefore, the clogging can be easily removed. Furthermore, since the treatment cell 2 can be used over and over by easily removing the clogging thereof, it does not have to be replaced with a new one unlike a conventional porous ring, and therefore, cost reduction can be achieved.

(3) Since a conventional porous ring made of sintered resin is not used, a cutting work operation for sintered resin is unnecessary. Accordingly, a reduction in the function of the flow-out means due to the heat generated during a cutting work never occurs in the present embodiment.

(4) If the small objects 100 are replaced with ones having larger minimum dimensions, the height dimension H of each gap channel 52 is preferably set to be larger; however, in that case, it is only necessary to form the deeper groove channels 521. In other words, as long as the small objects 100 are gradually replaced with ones having larger minimum dimensions, the depth of each groove channel 521 is gradually increased, thus enabling the reuse of the flow-out means. Accordingly, the present embodiment is economical.

Further, if the circulation amount of the plating solution 4 is desired to be increased, it is only necessary to increase the widths B (FIG. 21) and/or number of the groove channels 521. The widths B and/or number of the groove channels 521 can be increased by cutting the component being used (i.e., the bottom plate 24 in this case), and therefore, it is unnecessary to use any new component. Accordingly, the present embodiment is economical. It should be noted that, in order to increase the circulation amount of the plating solution 4, the structures shown in FIG. 23 through FIG. 27 may alternatively be adopted, although detailed description will be made about this later.

(5) Since the depth H and width B of each groove channel 521 can be set with accuracy, the height dimension H and width B (FIG. 20) of each gap channel 52 can be set with accuracy. Accordingly, the functions of the gap channels 52 can be properly achieved, and therefore, the circulation amount of the plating solution 4 can be set with accuracy.

Moreover, the plating process apparatus 1 of the present embodiment can achieve the following effects:

(1) Since the groove channels 521 are formed in the bottom plate 24 made of resin, the working cost for forming the groove channels 521 and the working cost for further deepening and/or widening the groove channels 521 are low.

(2) Since the groove channels 521 are formed between the adjacent through holes 241, the bolts 26 will not be exposed to the gap channels 52, and therefore, the plating solution 4 will not be brought into contact with the bolts 26. Accordingly, the plating can be prevented from being attached to the bolts 26. Therefore, the operation of removing the plating attached to the inside of the treatment cell 2 can be simplified.

(3) Since the groove channels 521 are formed between the adjacent through holes 241, a change in the height dimension H of each gap channel 52 associated with a change in the fastening force of the bolts 26 can be prevented.

(4) Since the peripheral edge portion 243 of the bottom plate 24 is protuberant and the inner face 2431 of the peripheral edge portion 243 is inclined downward and inward, the following effects can be achieved:

(i) Since the peripheral edge portion 243 of the bottom plate 24 is protuberant, the amount of the small objects 100 contained in the treatment cell 2 can be correspondingly increased. Accordingly, the throughput of the plating process can be increased.

(ii) Since the inner face 2431 of the protuberant peripheral edge portion 243 of the bottom plate 24 is inclined downward and inward, it becomes easy to allow the small objects 100 to reach the electrode ring 21. Accordingly, the efficiency of the plating process can be improved. In addition, since the small objects 100 move along the inclined inner face 2431, it is possible to reduce the impact caused when the small objects 100 collide against the electrode ring 21. Accordingly, the breakage of the small objects 100 can be suppressed.

(iii) Since the bottom plate 24 is made of resin, the material cost is low, and a working process for making the peripheral edge portion 243 protuberant can be easily performed; in addition, the inclination angle of the peripheral edge portion 243 can be easily changed in accordance with the type of the small objects 100.

(iv) Since the inclination is formed on the nonconductive bottom plate 24, the change and/or concentration of the current distribution due to the inclination can be prevented.

(v) When the treatment cell 2 is rotated, the small objects 100 go up along the inner face 2431 due to a centrifugal force, and when the treatment cell 2 is stopped, the small objects 100 go down along the inner face 2431 due to gravity. That is, if the treatment cell 2 is rotated and stopped repeatedly, the small objects 100 go up and down along the inner face 2431. Accordingly, by repeatedly rotating and stopping the treatment cell 2, the agitation of the small objects 100 can be promoted, and a plating process can be uniformly performed on the small objects 100.

It should be noted that, in the present embodiment, the following modified structures may further be adopted.

Figure 23:
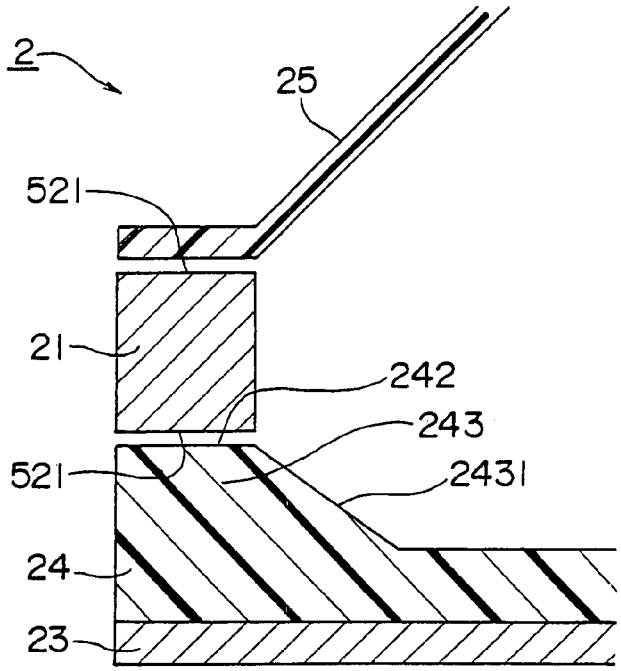
FIG. 23 is a partial front cross-sectional view showing a treatment cell having a first exemplary modified structure of the second embodiment.
Figure 24:
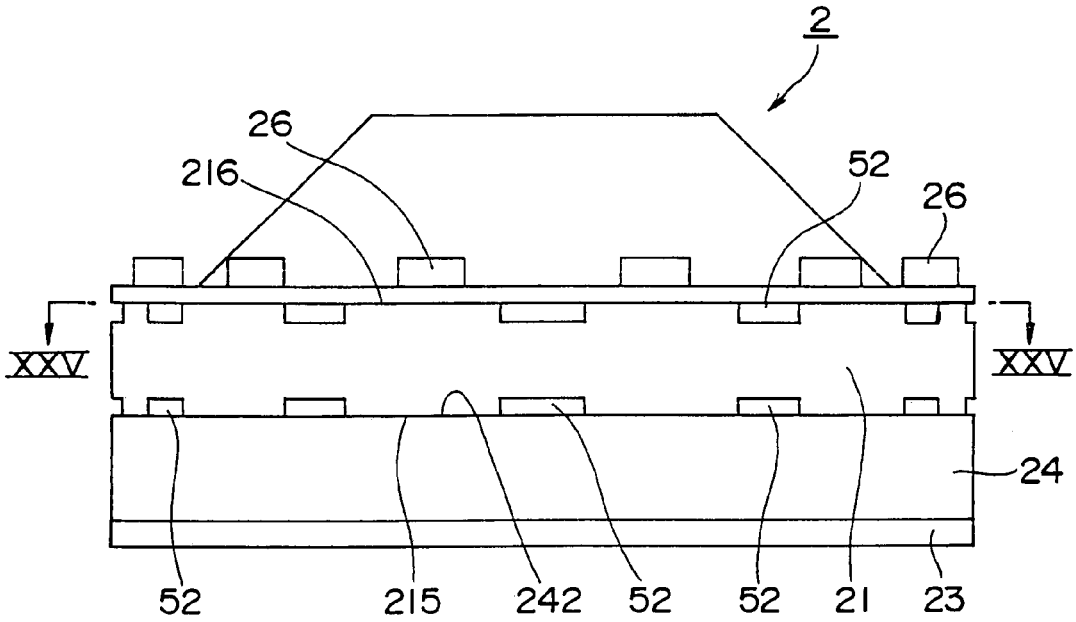
FIG. 24 is a front view of the treatment cell according to the example shown in FIG. 23.
Figure 25:
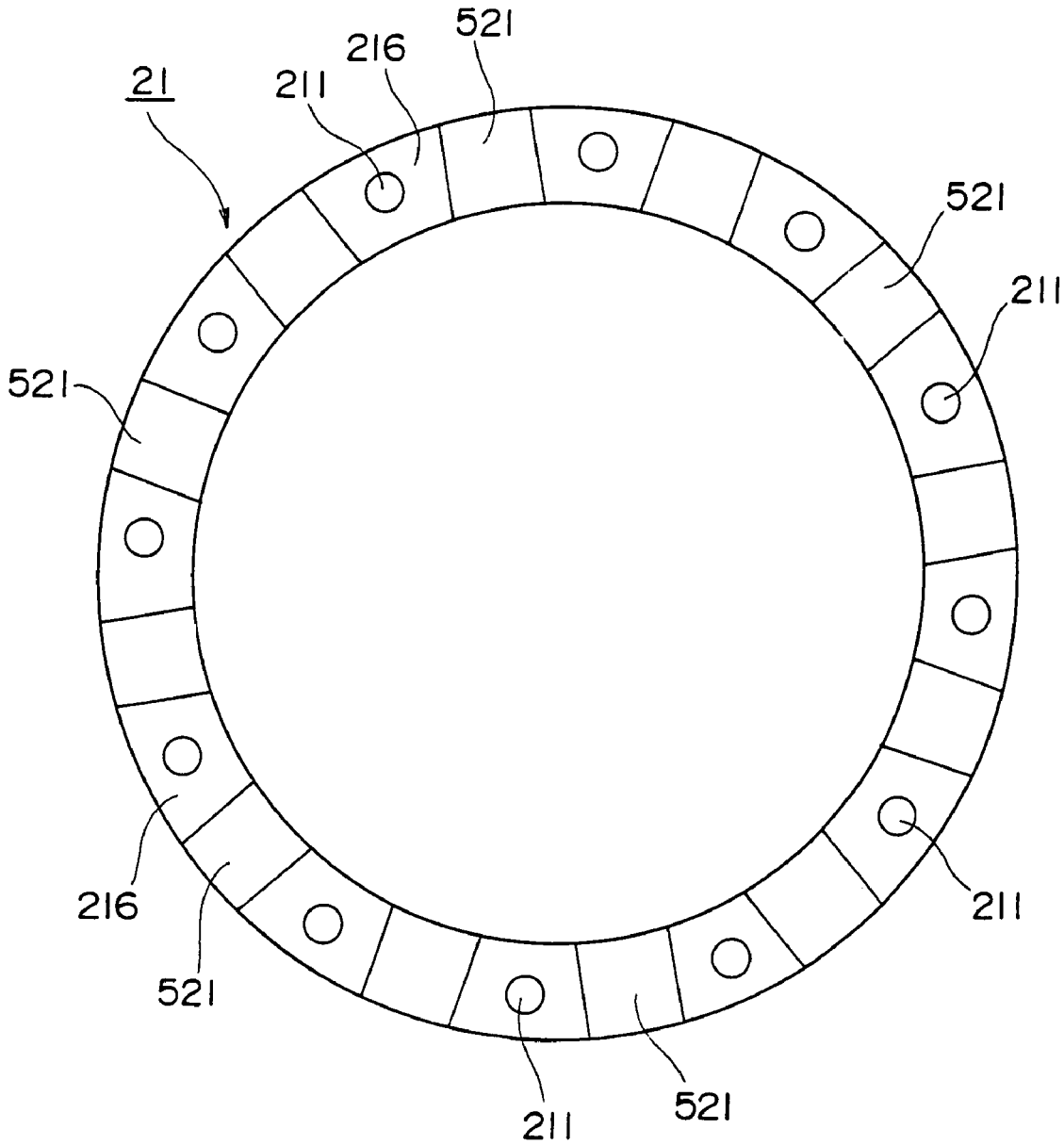
FIG. 25 is a diagram that is taken along the arrows XXV-XXV shown in FIG. 24, and that serves as a top view of an electrode ring according to the example shown in FIG. 23.

(1) As shown in FIG. 23 and FIG. 24, the groove channels 521 are formed at an abutment face 215 of the electrode ring 21, which abuts against the bottom plate 24, and the groove channels 521 are further formed at an abutment face 216 of the electrode ring 21, which abuts against the cover 25. FIG. 25 is a diagram that is taken along the arrows XXV-XXV shown in FIG. 24, and that serves as a top view showing the electrode ring 21. Also in such a structure, the gap channels 52 are formed between the bottom plate 24 and the electrode ring 21, and the gap channels 52 are further formed between the cover 25 and the electrode ring 21. Since the electrode ring 21 is normally made of metal, the groove channels 521 and the resulting gap channels 52 can each be formed into an accurate size by a cutting work. Hence, according to this example, the functions of the gap channels 52 can be properly achieved, and therefore, the circulation amount of the plating solution 4 can be set with accuracy.

It should be noted that the groove channels 521 maybe formed at only one of the upper face and lower face of the electrode ring 21. In that case, the groove channels 521 are preferably formed at the abutment face 215 serving as the lower face. This is because, due to the influence of gravity, it is easier for the plating solution 4 to circulate through the gap channels 52 between the bottom plate 24 and the electrode ring 21, than to circulate through the gap channels 52 between the cover 25 and the electrode ring 21.

Figure 26:
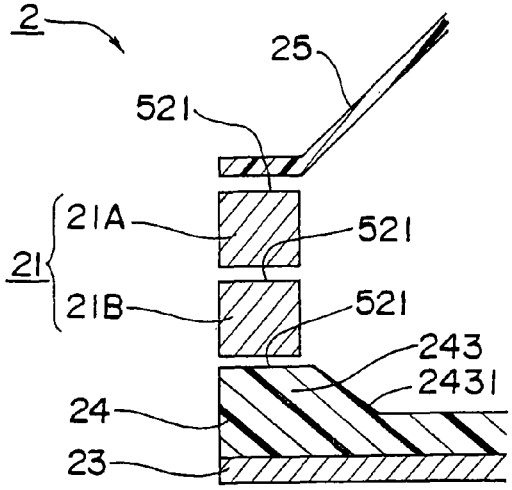
FIG. 26 is a partial front cross-sectional view showing a treatment cell having a second exemplary modified structure of the second embodiment.
Figure 27:
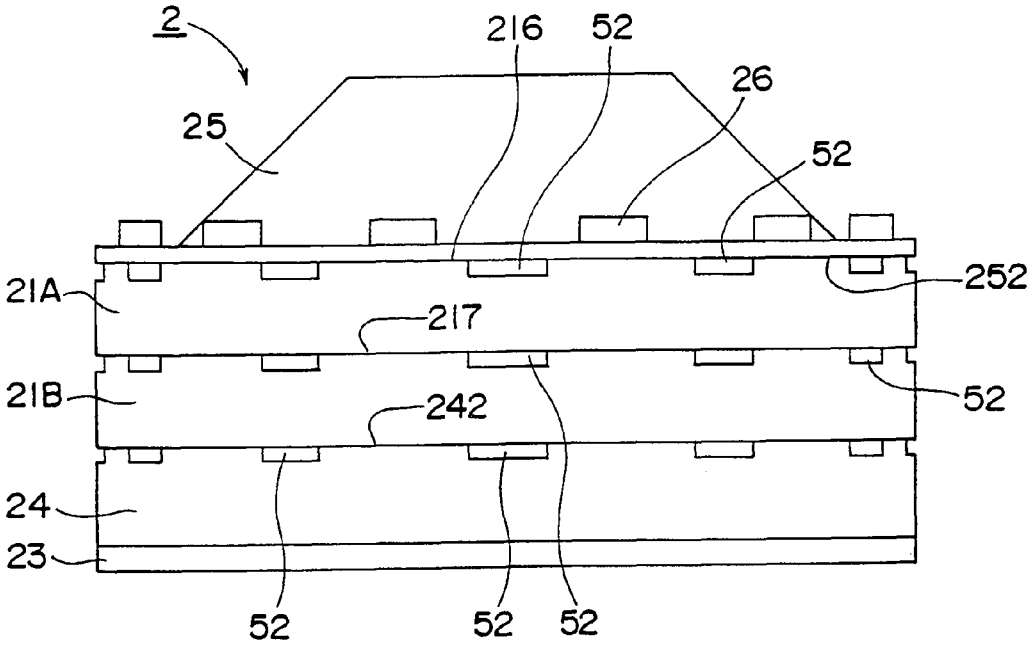
FIG. 27 is a front view of the treatment cell according to the example shown in FIG. 26.

(2) The groove channels are formed at least at any one of the abutment faces of electrode ring layers of the electrode ring 21 having a multilayer structure. In such a structure, since the gap channels 52 are formed between the electrode ring layers, the number of the gap channels 52 can be correspondingly increased with ease, and accordingly, the circulation amount of the plating solution 4 can be easily increased. For example, as shown in FIG. 26 and FIG. 27, in the electrode ring 21 having a two-layer structure, the groove channels 521 are formed at an abutment face 217 of an electrode ring layer 21B, which abuts against an electrode ring layer 21A. Thus, the gap channels 52 are formed between the electrode ring layer 21A and the electrode ring layer 21B. It should be noted that, in this example, the gap channels 52 consisting of the groove channels 521 at an abutment face 242 of the bottom plate 24 are provided between the bottom plate 24 and the electrode ring 21, while the gap channels 52 consisting of the groove channels 521 at an abutment face 216 of the electrode ring 21 are provided between the cover 25 and the electrode ring 21.

Figure 28:
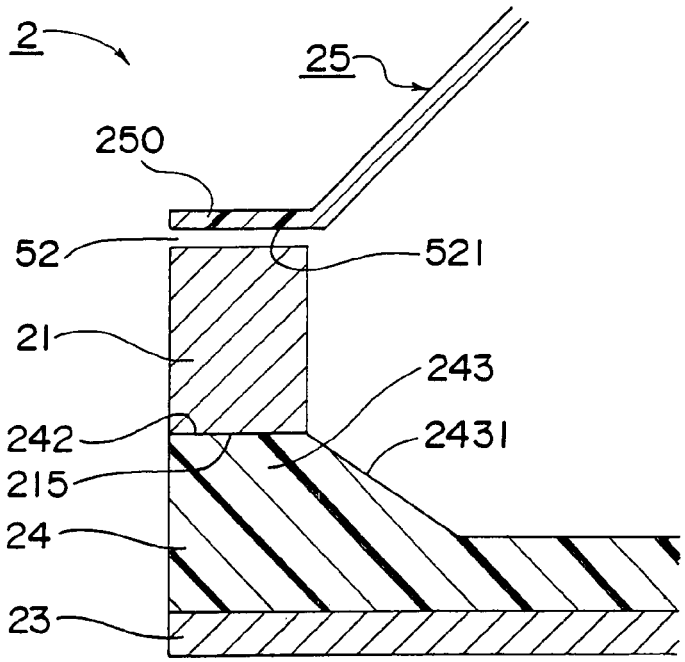
FIG. 28 is a partial front cross-sectional view showing a treatment cell having a third exemplary modified structure of the second embodiment.

(3) As shown in FIG. 28, the groove channels 521 are formed at an abutment face 252 (FIG. 27) of a flange portion 250 of the cover 25, which abuts against the electrode ring 21. In such a structure, the gap channels 52 are formed between the electrode ring 21 and the cover 25. Actually, it is harder for the plating solution 4 to pass through the gap channels 52 located at high positions than to pass through the gap channels 52 located at low positions. Accordingly, by providing the gap channels 52 at high positions as in this example, the circulation amount of the plating solution 4 can be easily decreased.

Figure 29:
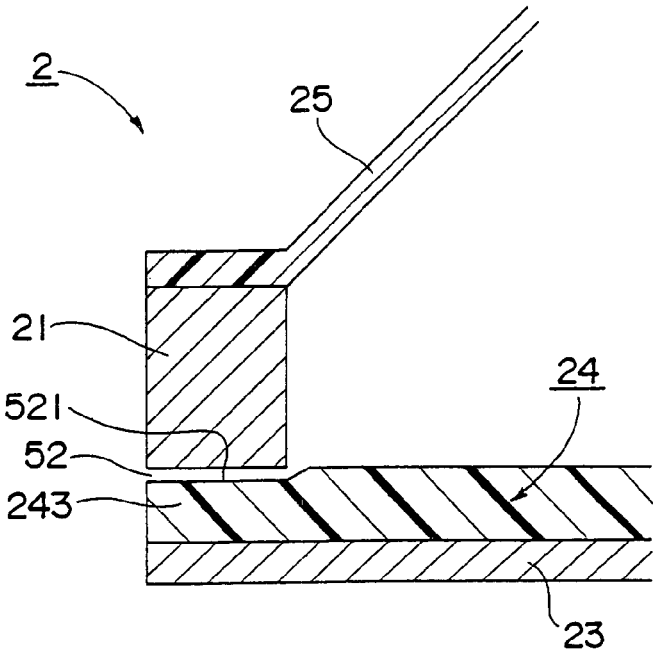
FIG. 29 is a partial front cross-sectional view showing a treatment cell having a fourth exemplary modified structure of the second embodiment.

(4) A component whose peripheral edge portion 243 is not protuberant, i.e., a flat plate, is used as the bottom plate 24. In this case, the groove channels 521 are preferably formed in the electrode ring 21, and as shown in FIG. 29, the groove channels 521 may be formed by digging down the surface of the peripheral edge portion 243 of the bottom plate 24. Also in such a structure, the gap channels 52 are formed between the bottom plate 24 and the electrode ring 21.

Figure 30:
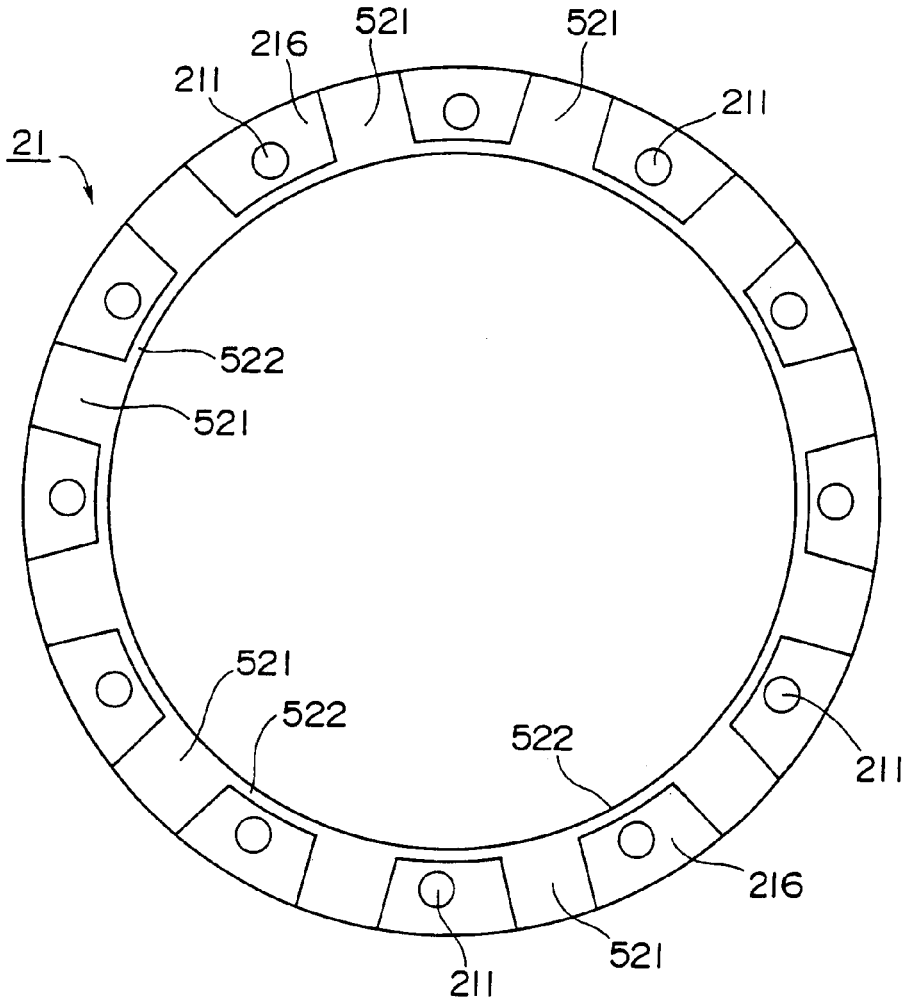
FIG. 30 is a top view of an electrode ring having a fifth exemplary modified structure of the second embodiment.
Figure 31:
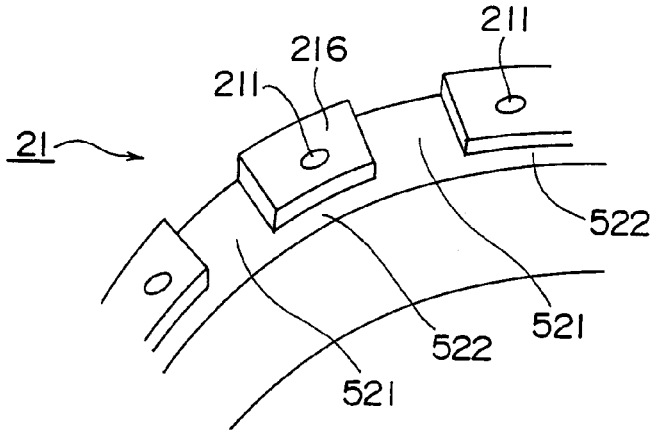
FIG. 31 is a partial top perspective view of the electrode ring shown in FIG. 30.

(5) FIG. 30 is a top view of the electrode ring 21, and FIG. 31 is a partial top perspective view of FIG. 30. In this example, a plurality of the groove channels 521 are communicated with each other through a cutout portion 522 formed by cutting out an inner edge portion of the abutment face 216 at which the groove channels 521 are formed. In such a structure, since the cutout portion 522 constitutes a large inlet channel communicated with the gap channels 52, the collision of the small objects 100 against the inlet peripheral edges of the gap channels 52 can be suppressed, and accordingly, the breakage of the small objects 100 can be suppressed; It should be noted that the similar structure may also be adopted at the lower face of the electrode ring 21.

(6) The groove channels 521 are formed so as to traverse the through holes 241, the through holes 211, or the through holes 251.

(7) In the case where the electrode ring 21 has a multilayer structure, the electrode ring layer(s) except any one of the electrode ring layers is/are made of resin. In such a structure, the working cost and material cost can be reduced. It should be noted that, even in such a structure, a plating process is performed because at least one of the electrode ring layers is conductive.

(8) An arbitrary number of the groove channels 521 are provided. In such a structure, the number of the gap channels 52 can be easily changed. Accordingly, the circulation amount of the plating solution 4 can be easily adjusted.

(9) The groove channels 521, each having an arbitrary width, are formed. In such a structure, the working cost can be reduced. Furthermore, the circulation amount of the plating solution 4 can be easily adjusted.

Figure 32:
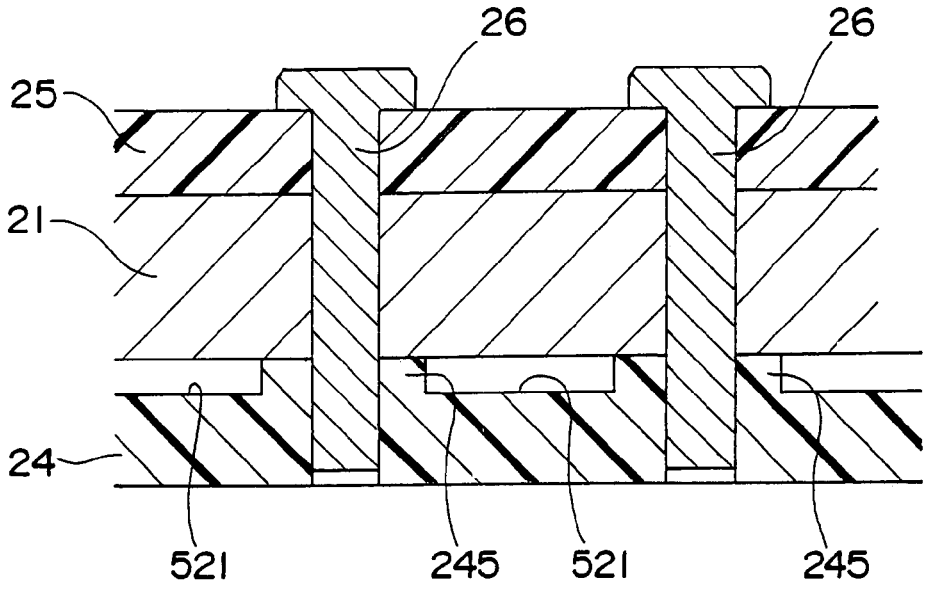
FIG. 32 is a partial cross-sectional view of a treatment cell having a tenth exemplary modified structure of the second embodiment.

(10) As shown in FIG. 32, protrusions 245 are formed in the bottom plate 24, thus forming the groove channels 521 between the bottom plate 24 and the electrode ring 21. In such a structure, compared with the case where the groove channels 521 are formed by cutting, the groove channels 521 can be formed easily. Furthermore, the groove channels 521 may be formed between the cover 25 and the electrode ring 21 in the similar manner. It should be noted that, although the bolts 26 are passed through the protrusions 245 in the example shown in FIG. 32, the bolts 26 may alternatively be provided so as to pass through the groove channels 521.

Figure 33:
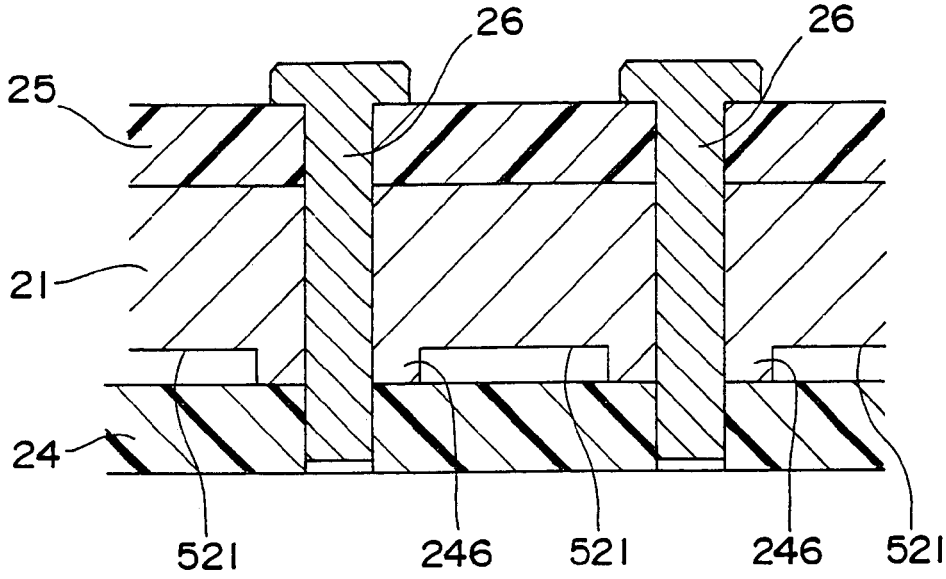
FIG. 33 is a partial cross-sectional view of a treatment cell having an eleventh exemplary modified structure of the second embodiment.

(11) As shown in FIG. 33, protrusions 246 are formed in the electrode ring 21, thus forming the groove channels 521 between the bottom plate 24 and the electrode ring 21. In such a structure, compared with the case where the groove channels 521 are formed by cutting, the groove channels 521 can be formed easily. Furthermore, the groove channels 521 may be formed between the cover 25 and the electrode ring 21 in the similar manner. It should be noted that, although the bolts 26 are passed through the protrusions 246 in the example shown in FIG. 33, the bolts 26 may alternatively be provided so as to pass through the groove channels 521.

Figure 34:
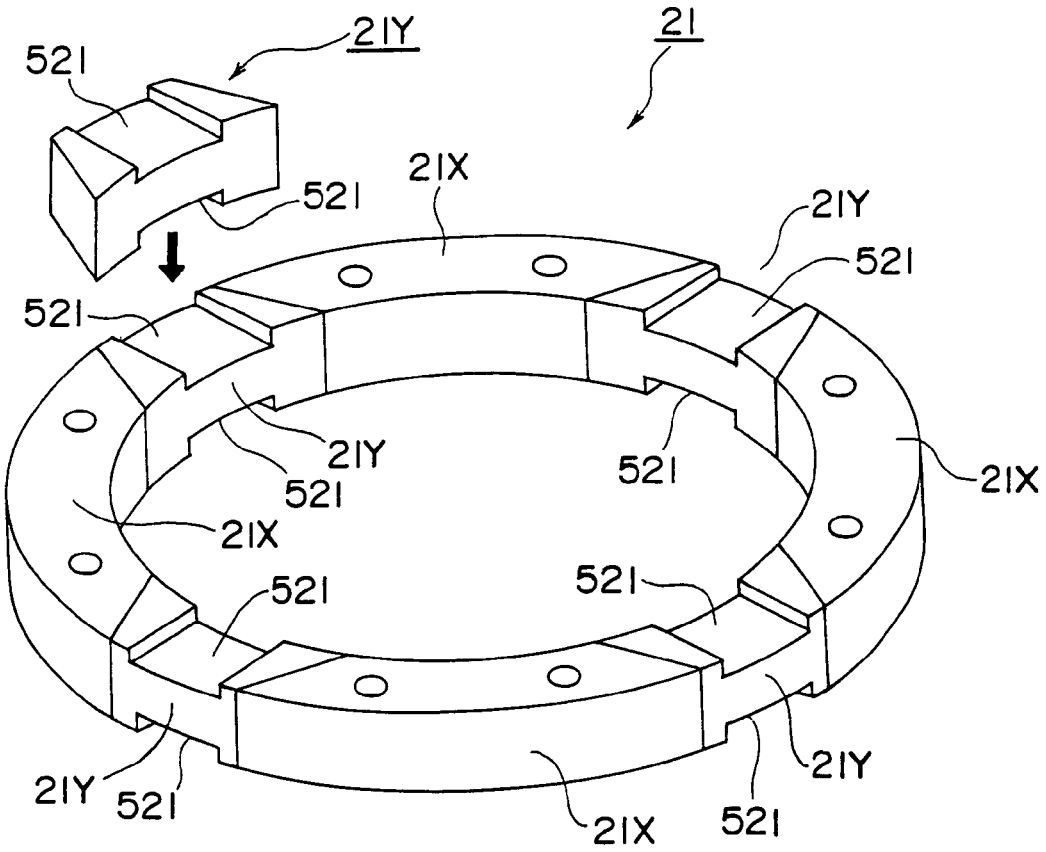
FIG. 34 is a top perspective view of an electrode ring having a twelfth exemplary modified structure of the second embodiment.
Figure 35:
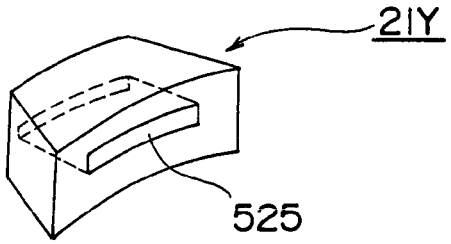
FIG. 35 is a perspective view of another exemplary second ring portion used for the electrode ring shown in FIG. 34.
Figure 36:
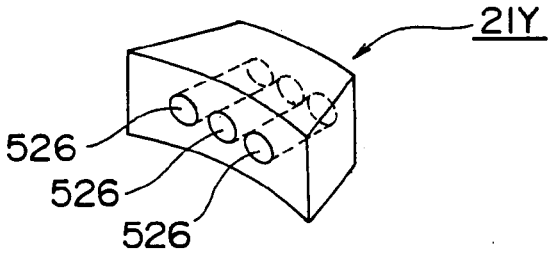
FIG. 36 is a perspective view of still another exemplary second ring portion used for the electrode ring shown in FIG. 34.

(12) As shown in FIG. 34, the electrode ring 21 is formed to include: first ring portions 21X; and second ring portions 21Y having the groove channels 521. The electrode ring 21 is formed by detachably connecting the first ring portions 21X with the second ring portions 21Y. The second ring portions 21Y each have the groove channel 521 at its upper face and/or lower face. In such a structure, the width and/or depth of each gap channel 52 of the treatment cell 2 can be changed by only replacing the second ring portion 21Y with the other second ring portion 21Y having the groove channel 521 whose width and/or depth are/is different. In other words, it is possible to change the width and/or depth of each gap channel 52 without replacing the entire electrode ring 21. Further, the second ring portions 21Y are made of resin, thus enabling a reduction in the weight of the electrode ring 21, and enabling a reduction in energization area. It should be noted that the second ring portion 21Y having a through groove 525 as shown in FIG. 35, or the second ring portion 21Y having through holes 526 as shown in FIG. 36 may alternatively be used.

Figure 37:
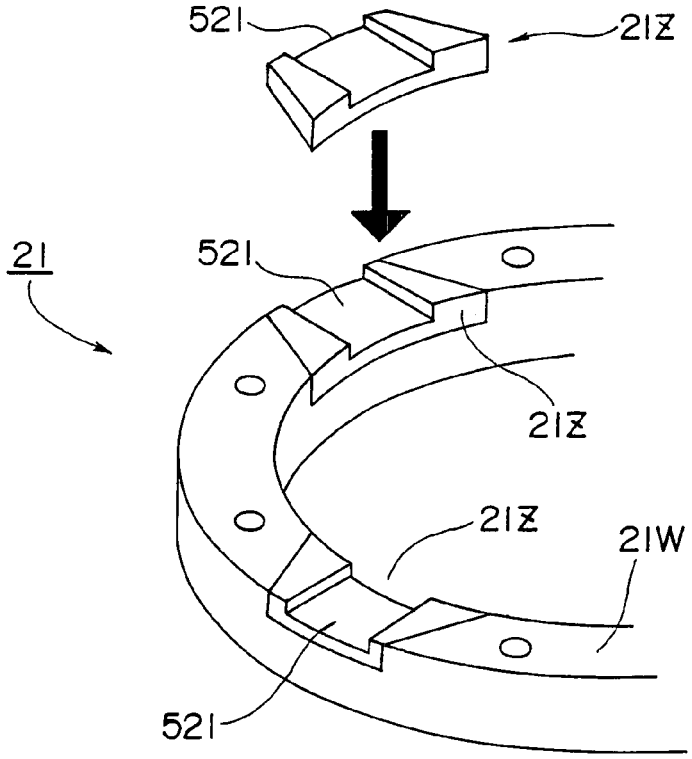
FIG. 37 is a partial top perspective view of an electrode ring having a thirteenth exemplary modified structure of the second embodiment.
Figure 38:
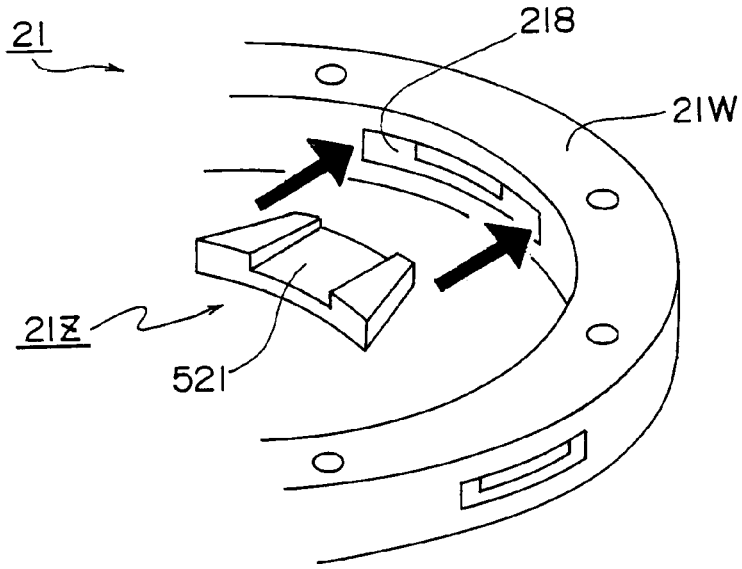
FIG. 38 is a partial top perspective view of a variation of the electrode ring according to the thirteenth exemplary modified structure.

(13) As shown in FIG. 37, the electrode ring 21 is formed to include: a ring main body 21W; and components 21Z having the groove channels 521. The electrode ring 21 is formed by detachably attaching the components 21Z to the ring main body 21W. The components 21Z each have the groove channel 521 at its upper face and/or lower face. Furthermore, the components 21Z are formed so as to be attached to an upper face and/or a lower face of the ring main body 21W. In such a structure, the width and/or depth of each gap channel 52 of the treatment cell 2 can be changed by only replacing the component 21Z with the other component 21Z having the groove channel 521 whose width and/or depth are/is different. In other words, it is possible to change the width and/or depth of each gap channel 52 without replacing the entire electrode ring 21. Moreover, the components 21Z are made of resin, thus enabling a reduction in the weight of the electrode ring 21, and enabling a reduction in energization area. It should be noted that the component 21Z formed so as to be fitted into a through hole 218 of the ring main body 21W as shown in FIG. 38 may alternatively be used.

Figure 39:
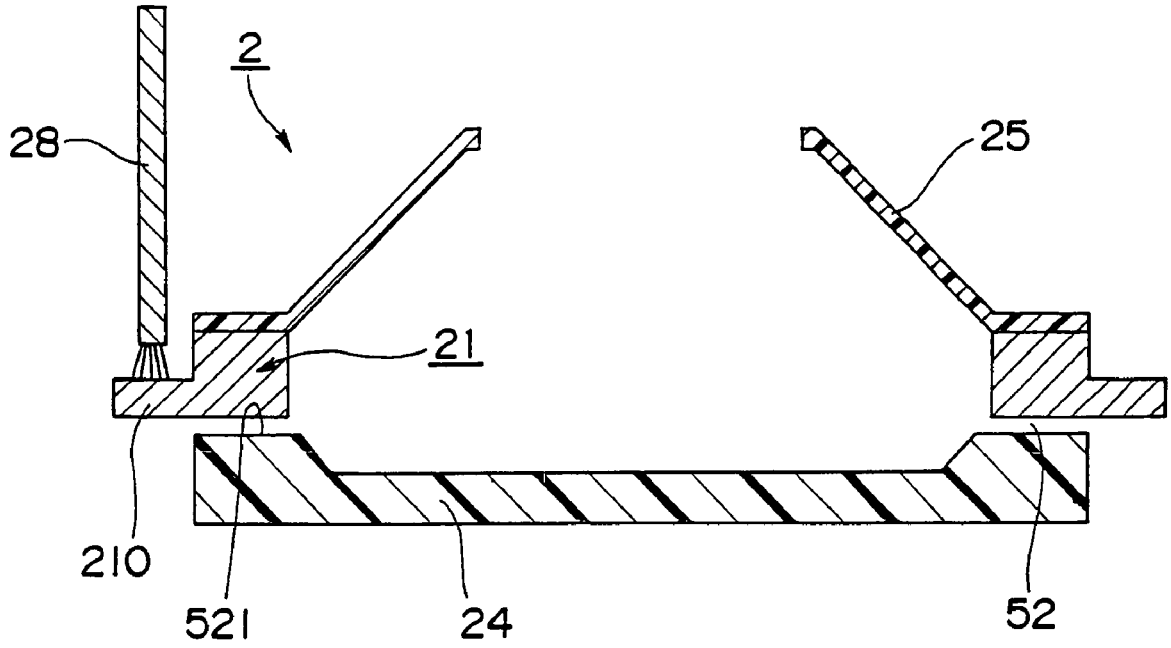
FIG. 39 is a front cross-sectional view of a treatment cell having a fourteenth exemplary modified structure of the second embodiment.

(14) As shown in FIG. 39, an feed brush 28 is provided so as to be in direct contact with the electrode ring 21, thus forming an energization means. In this structure, the electrode ring 21 has an outer flange 210, and the feed brush 28 is in contact with the outer flange 210 from above. In such a structure, since the energization means can be simplified, the structure of the treatment cell 2 itself can also be simplified. It should be noted that the bottom plate 24 may have the protuberant peripheral edge portion 243.

Figure 40:
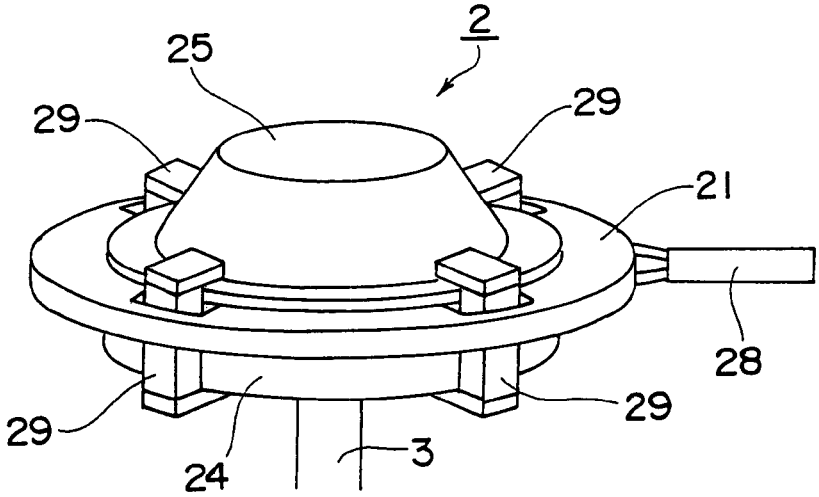
FIG. 40 is a top perspective view of a treatment cell having a fifteenth exemplary modified structure of the second embodiment.
Figure 41:
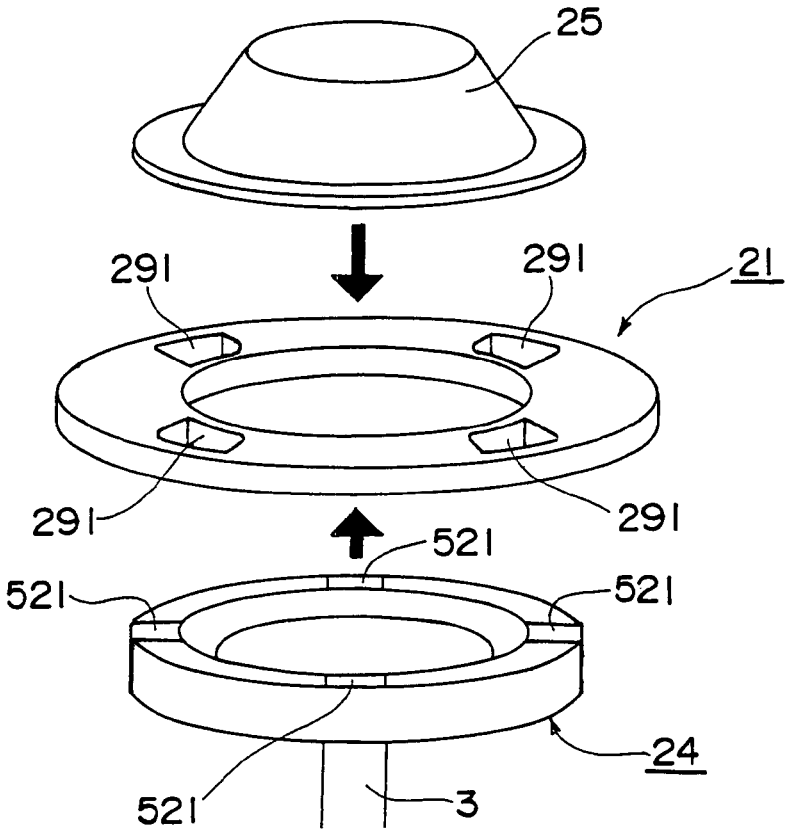
FIG. 41 is an exploded view of the treatment cell shown in FIG. 40.

(15) As shown in FIG. 40, the feed brush 28 is provided so as to be in direct contact with the electrode ring 21 laterally, thus forming an energization means. Also in such a structure, since the energization means can be simplified, the structure of the treatment cell 2 itself can also be simplified. It should be noted that, in the example shown in FIG. 40, the bottom plate 24, the electrode ring 21 and the cover 25 are combined using clamps 29 instead of bolts. FIG. 41 is an exploded view of the example shown in FIG. 40. As shown in FIG. 41, through holes 291, through which the clamps 29 are passed, are formed in the electrode ring 21.

Third Embodiment

The present embodiment relates to an apparatus for performing a process that does not require energization to be carried out in a surface treatment. Examples of such a process include an immersion plating process, a chemical plating process, a chemical composite plating process, a degreasing process, a barrel polishing process, an alkaline immersion cleaning process, a pickling process, a chemical polishing process, a neutralization process, a draining-induced tarnish prevention process, a water-soluble resin process, and a chromate process. It should be noted that such a process may be performed using the apparatus of the first embodiment or second embodiment without carrying out energization.

Figure 42:
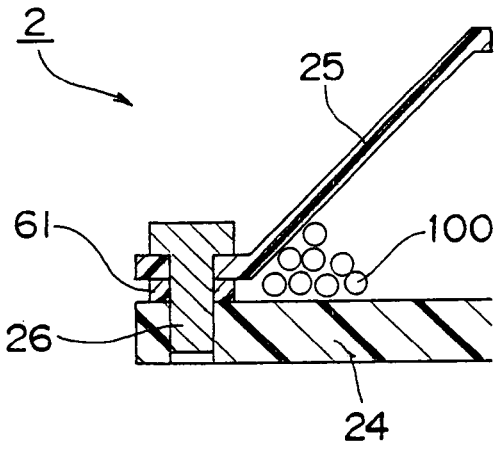
FIG. 42 is a partial front cross-sectional view of a treatment cell according to a third embodiment.
Figure 43:
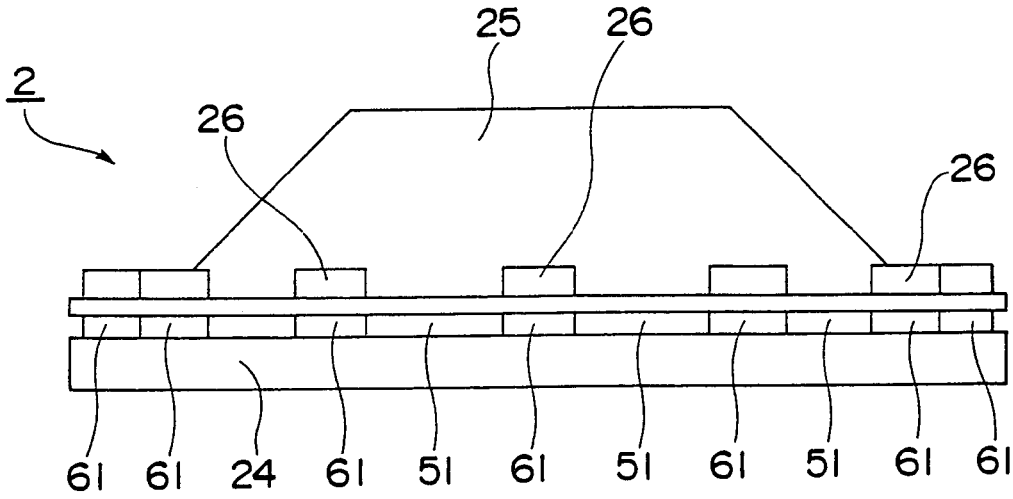
FIG. 43 is a front view of the treatment cell shown in FIG. 42.

FIG. 42 is a partial front cross-sectional view showing a treatment cell of a surface treatment apparatus for small objects according to the present embodiment, and FIG. 43 is a front view of the treatment cell. The treatment cell 2 of the present embodiment differs from the treatment cell 2 of the first embodiment only in that the treatment cell 2 of the present embodiment does not include the electrode ring 21 and the base plate 23. In other words, the treatment cell 2 of the present embodiment has sheet members 61 sandwiched between a bottom plate 24 and a cover 25, and gap channels 51 formed therebetween. The bottom plate 24 and the cover 25 are combined with bolts 26.

The treatment cell 2 of the present embodiment is operated similarly to the treatment cell 2 of the first embodiment in performing a surface treatment on small objects 100 except that energization is not carried out. Specifically, a surface treatment solution within the treatment cell 2 flows out through the gap channels 51 due to a centrifugal force caused by the rotation of the treatment cell 2. On the other hand, since the height dimension of each gap channel 51 is smaller than the minimum dimension of each small object 100, the gap channels 51 do not allow the small objects 100 to pass therethrough. Accordingly, the gap channels 51 each function as a filter that prevents the small objects 100 from passing therethrough but allows the surface treatment solution to pass therethrough. Therefore, the surface treatment apparatus 1 having the above-described structure can perform a surface treatment on the small objects 100 without losing the small objects 100, and enables the cyclic use of the surface treatment solution.

The apparatus 1 of the present embodiment can also achieve the effects similar to those of the apparatus 1 of the first embodiment.

Figure 44:
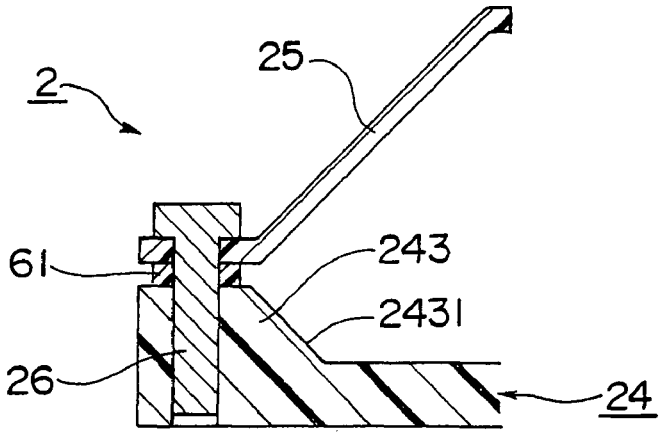
FIG. 44 is a partial front cross-sectional view of a first exemplary modified structure of the third embodiment.
Figure 45:
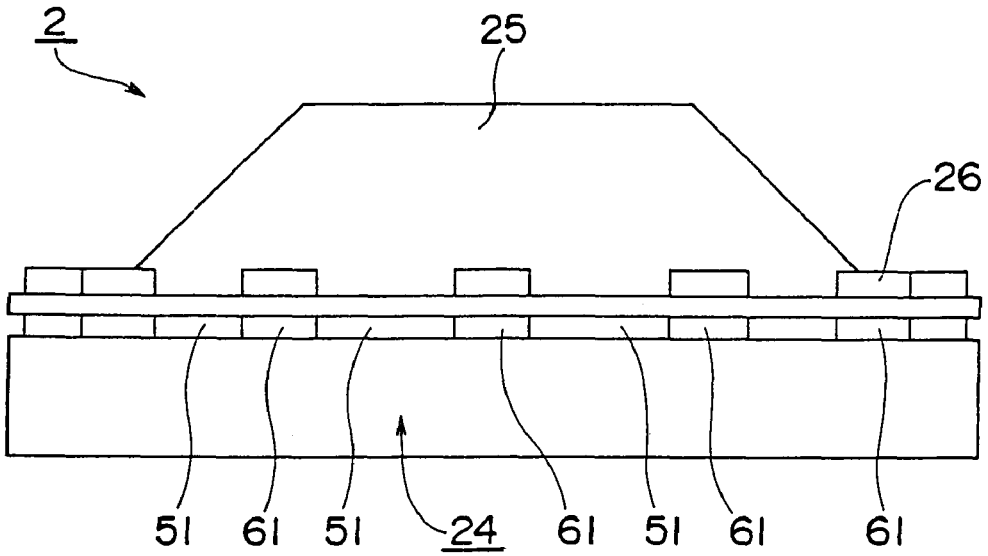
FIG. 45 is a front view of the treatment cell shown in FIG. 44.

It should be noted that, as shown in FIG. 44, the bottom plate 24 having a protuberant peripheral edge portion 243 may alternatively be used. FIG. 45 is a front view of the treatment cell 2 shown in FIG. 44.

Figure 46:
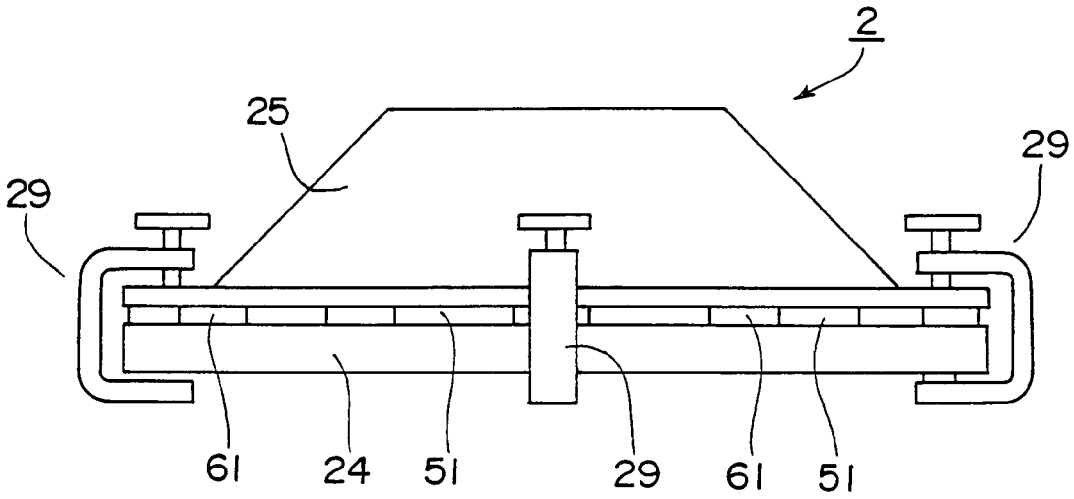
FIG. 46 is a front view of a second exemplary modified structure of the third embodiment.

Furthermore, as shown in FIG. 46, the bottom plate 24 and the cover 25 may be combined using clamps 29 instead of the bolts 26 so that the bottom plate 24 and the cover 25 are vertically sandwiched at outer portions thereof.

Fourth Embodiment

The present embodiment relates to an apparatus for performing a process that does not require energization to be carried out in a surface treatment. Examples of such a process include an immersion plating process, a chemical plating process, a chemical composite plating process, a degreasing process, a barrel polishing process, an alkaline immersion cleaning process, a pickling process, a chemical polishing process, a neutralization process, a draining-induced tarnish prevention process, a water-soluble resin process, and a chromate process. It should be noted that such a process may be performed using the apparatus of the first embodiment or second embodiment without carrying out energization.

Figure 47:
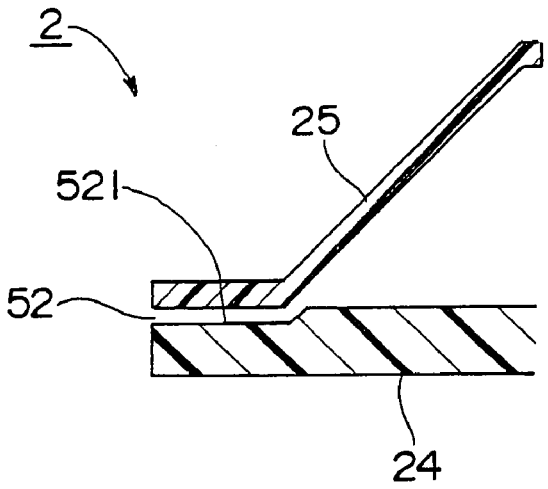
FIG. 47 is a partial front cross-sectional view of a treatment cell according to a fourth embodiment.
Figure 48:
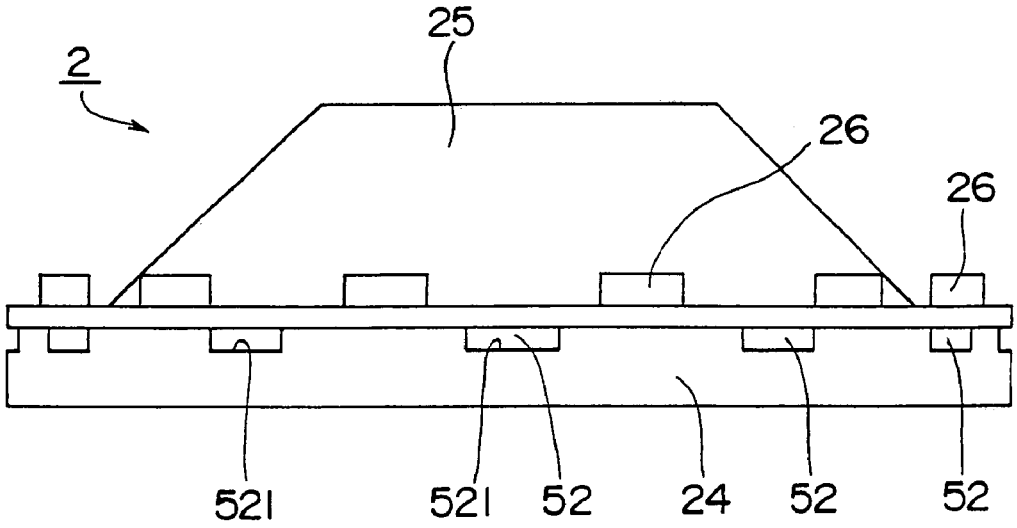
FIG. 48 is a front view of the treatment cell shown in FIG. 47.

FIG. 47 is a partial front cross-sectional view showing a treatment cell of a surface treatment apparatus for small objects according to the present embodiment, and FIG. 48 is a front view of the treatment cell. The treatment cell 2 of the present embodiment differs from the treatment cell 2 of the second embodiment only in that the treatment cell 2 of the present embodiment does not include the electrode ring 21 and the base plate 23. In other words, the treatment cell 2 of the present embodiment has gap channels 52 consisting of groove channels 521 between a bottom plate 24 and a cover 25. The bottom plate 24 and the cover 25 are combined with bolts 26.

The treatment cell 2 of the present embodiment is operated similarly to the treatment cell 2 of the second embodiment in performing a surface treatment on small objects 100 except that energization is not carried out. Specifically, a surface treatment solution within the treatment cell 2 flows out through the gap channels 52 due to a centrifugal force caused by the rotation of the treatment cell 2. On the other hand, since the height dimension of each gap channel 52 is smaller than the minimum dimension of each small object 100, the gap channels 52 do not allow the small objects 100 to pass therethrough. Accordingly, the gap channels 52 each function as a filter that prevents the small objects 100 from passing therethrough but allows the surface treatment solution to pass therethrough. Therefore, the surface treatment apparatus 1 having the above-described structure can perform a surface treatment on the small objects 100 without losing the small objects 100, and enables the cyclic use of the surface treatment solution.

The apparatus 1 of the present embodiment can also achieve the effects similar to those of the apparatus 1 of the second embodiment.

Figure 49:
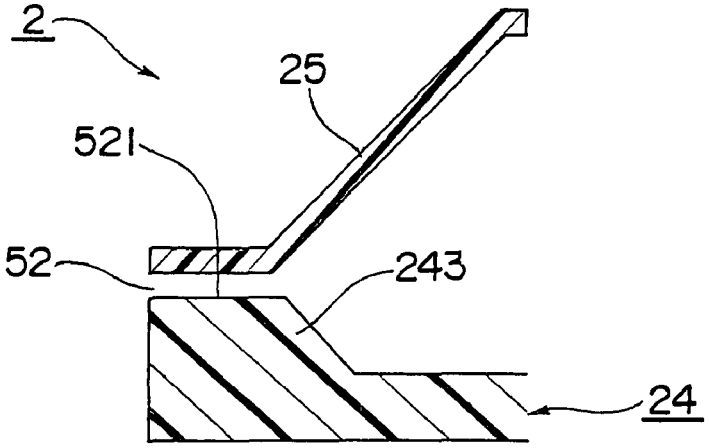
FIG. 49 is a partial front cross-sectional view of a first exemplary modified structure of the fourth embodiment.
Figure 50:
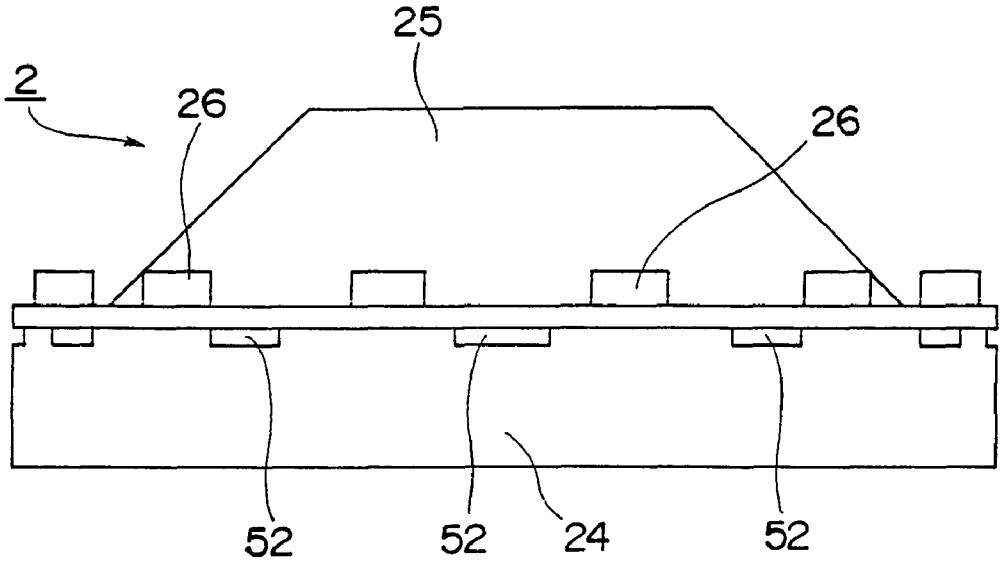
FIG. 50 is a front view of the treatment cell shown in FIG. 49.

It should be noted that, as shown in FIG. 49, the bottom plate 24 having a protuberant peripheral edge portion 243 may alternatively be used. FIG. 50 is a front view of the treatment cell 2 shown in FIG. 49. Also in such a structure, the effects similar to those of the apparatus 1 of the second embodiment can be achieved.

Figure 51:
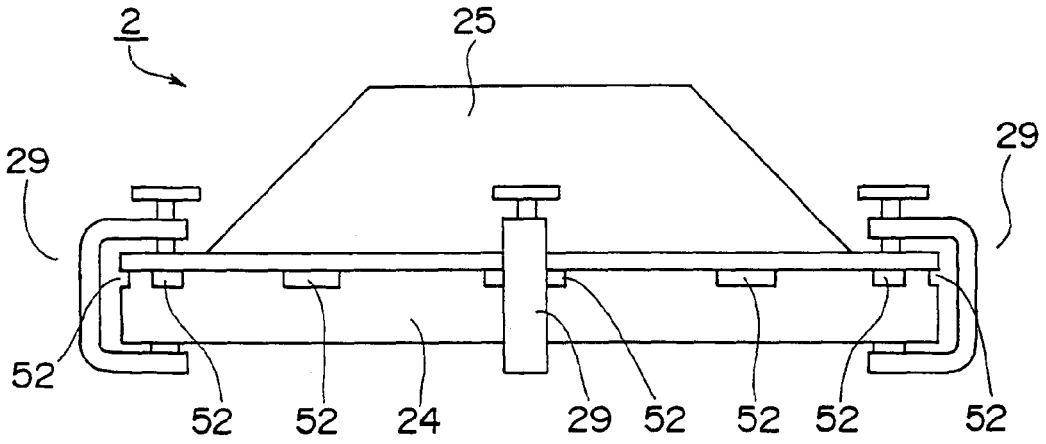
FIG. 51 is a front view of a second exemplary modified structure of the fourth embodiment.

Furthermore, as shown in FIG. 51, the bottom plate 24 and the cover 25 may be combined using clamps 29 instead of the bolts 26 so that the bottom plate 24 and the cover 25 are vertically sandwiched at outer portions thereof.

Other Embodiments

In the apparatuses 1 to which the first embodiment through fourth embodiment are applied as a flow-out means, an attachment and detachment means described below may be adopted. It should be noted that, hereinafter, the description will be made about the case where the attachment and detachment means is adopted in the apparatus 1 to which the first embodiment is applied.

Figure 52:
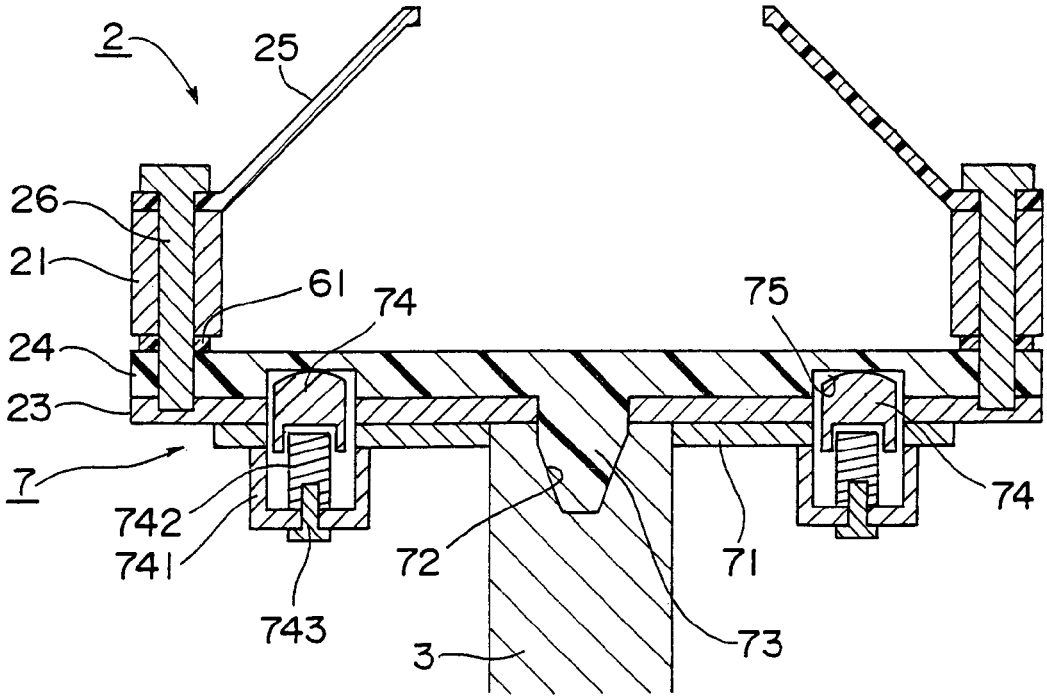
FIG. 52 is a front cross-sectional view of a plating process apparatus for small objects according to another embodiment.
Figure 53:
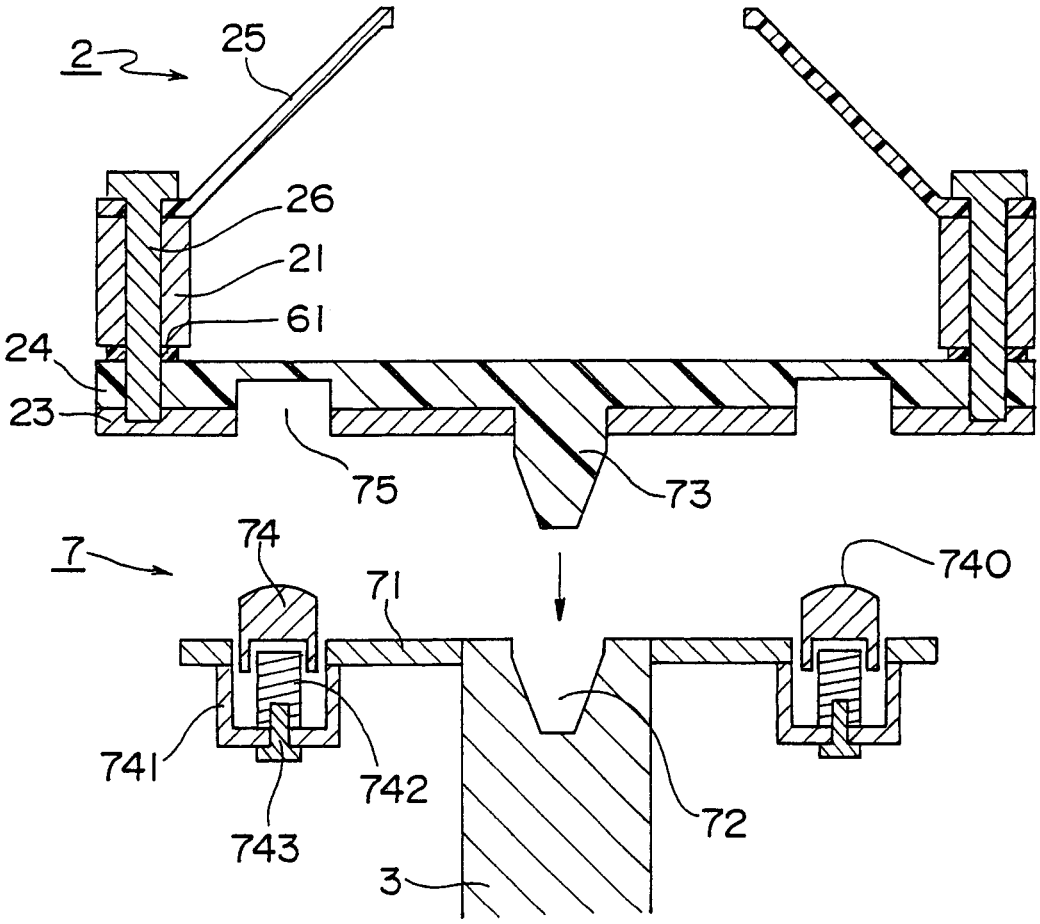
FIG. 53 is a front cross-sectional view showing the detached state of the plating process apparatus shown in FIG. 52.

FIG. 52 is a schematic front cross-sectional view showing a plating process apparatus for small objects, in which the attachment and detachment means 7 is adopted. As shown in FIG. 53, the attachment and detachment means 7 is a means for detachably fixing a treatment cell 2 to a vertical rotation shaft 3.

Figure 54:
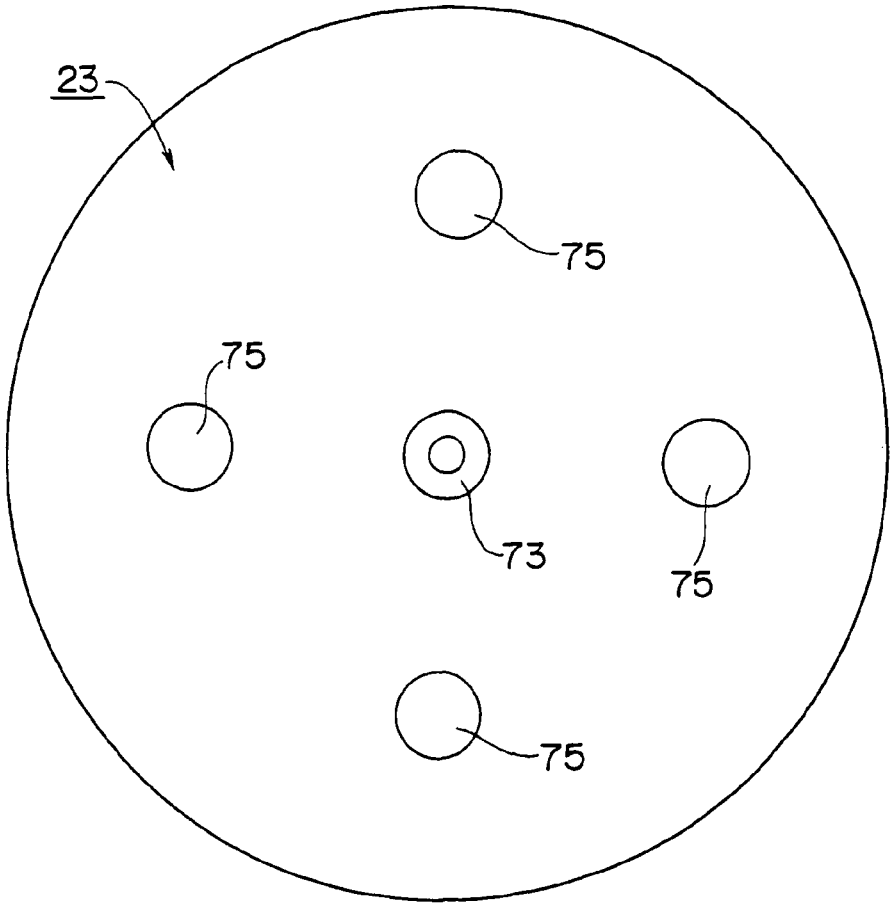
FIG. 54 is a bottom view of a base plate of the plating process apparatus shown in FIG. 52.

The attachment and detachment means 7 is formed to include: a horizontal conductive receiving plate 71 fixed at an upper end of the vertical rotation shaft 3; a concave portion 72 formed at a rotational center of the receiving plate 71; a convex portion 73 provided at a rotational center of a lower face of a base plate 23 of the treatment cell 2; protrusive portions 74 provided at a plurality of positions of the receiving plate 71; and hole portions 75 formed at the base plate 23 and bottom plate 24 of the treatment cell 2. On the receiving plate 71, the treatment cell 2 is placeable. The concave portion 72 has a tapered form. The convex portion 73 is formed so as to be fitted into the concave portion 72. The protrusive portions 74 are each provided so as to be able to be protruded from an upper face of the receiving plate 71. The hole portions 75 are formed so that the protrusive portions 74, protruded from the upper face of the receiving plate 71, are fitted thereto. It should be noted that, at the receiving plate 71, the protrusive portions 74 are preferably located circumferentially at regular intervals, and the number of the protrusive portions 74 is preferably two, four, five, six or eight, for example. The number and location of the hole portions 75 correspond to those of the protrusive portions 74. FIG. 54 is a bottom view of the base plate 23, and in this case, the four hole portions 75 are provided.

Figure 55:
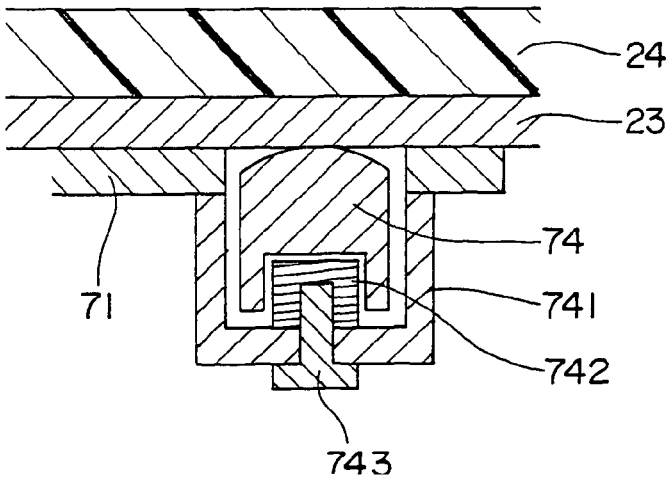
FIG. 55 is an enlarged front view of a protrusive portion of the plating process apparatus shown in FIG. 52.

More specifically, the protrusive portions 74 are provided in the state where they are each urged upward by a spring 742 supported by a pin 743 within a recessed portion 741 provided at the receiving plate 71. An upper end face 740 of each protrusive portion 74 is spherical. Further, as shown in FIG. 55, in the case where a flat region of the lower face of the base plate 23 faces the recessed portion 741, the protrusive portion 74 is pressed downward by this flat region and pushed inside the recessed portion 741. On the other hand, as shown in FIG. 52, in the case where the hole portions 75 formed at the base plate 23 and the bottom plate 24 face the recessed portions 741, the protrusive portions 74 are each pressed upward by the spring 742 and fitted into the hole portion 75.

Due to the above-described attachment and detachment means 7, the treatment cell 2 is fixed to the vertical rotation shaft 3 via the receiving plate 71 while the convex portion 73 is fitted into the concave portion 72 of the receiving plate 71 and the protrusive portions 74 of the receiving plate 71 are fitted into the hole portions 75. Furthermore, a rotational force of the vertical rotation shaft 3 is transmitted to the fixed treatment cell 2 via the receiving plate 71. Accordingly, the treatment cell 2 can be rotated together with the vertical rotation shaft 3 while being fixed to the vertical rotation shaft 3 via the receiving plate 71.

In the above-described attachment and detachment means 7, the convex portion 73 provided at the rotational center of the lower face of the base plate 23 of the treatment cell 2 is fitted into the concave portion 72 formed at the rotational center of the receiving plate 71, and therefore, the rotational center of the treatment cell 2 can be accurately positioned with respect to the vertical rotation shaft 3.

In addition, since the protrusive portions 74 are fitted into a plurality (in this embodiment, four) of the hole portions 75, a rotational force of the vertical rotation shaft 3 can be transmitted to the treatment cell 2 via the receiving plate 71 and the protrusive portions 74 with certainty.

Figure 56:
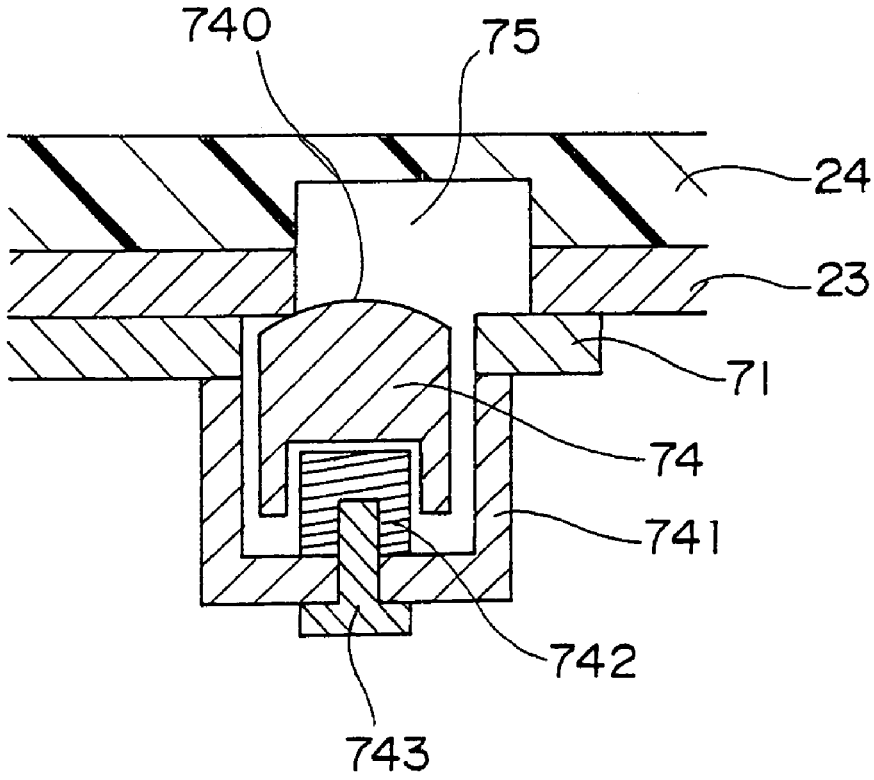
FIG. 56 is a partial front cross-sectional view showing how the operation of placing the plating process apparatus shown in FIG. 52 is performed.
Figure 57:
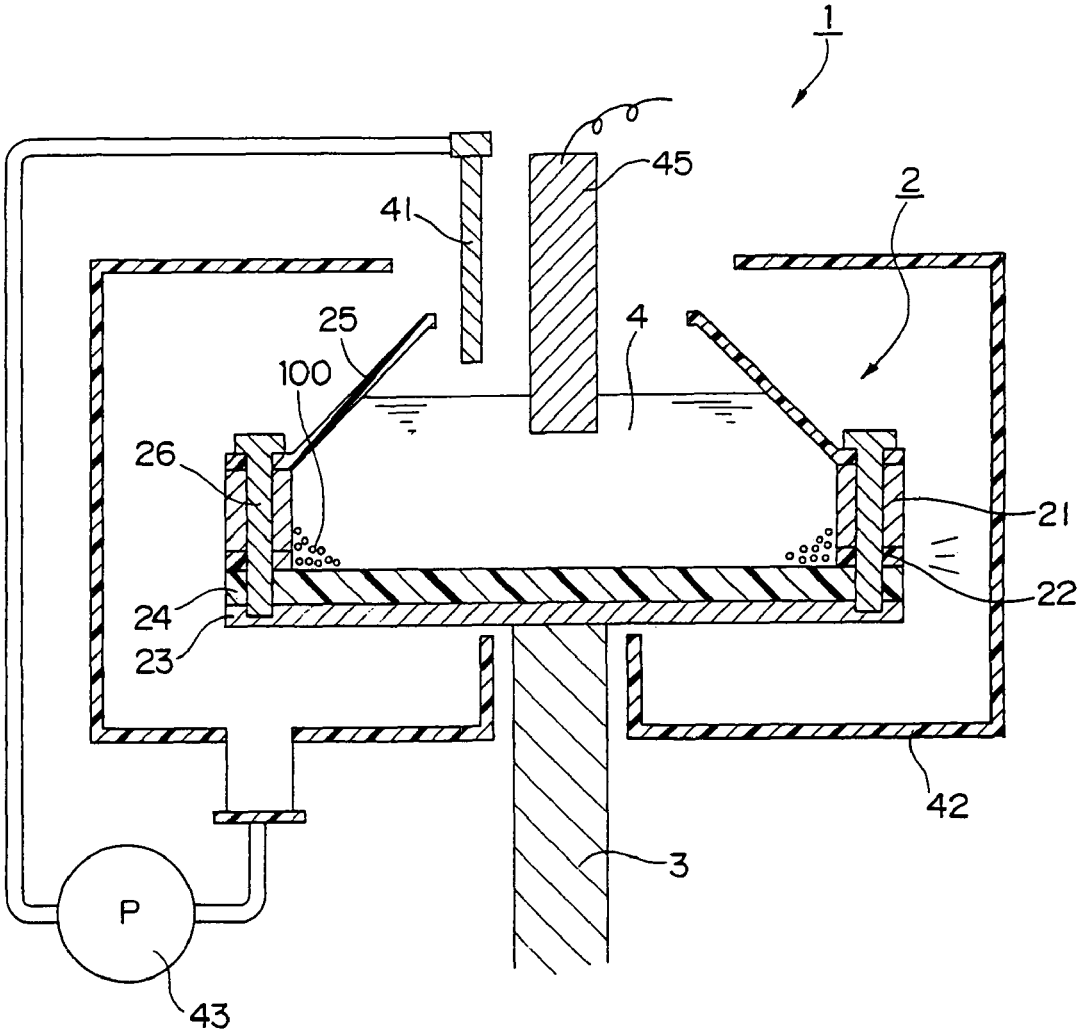
FIG. 57 is a front cross-sectional view showing a conventional plating process apparatus for small objects.

Further, since the upper end face 740 of each protrusive portion 74 is spherical, the upper end of each protrusive portion 74 can be inserted into the hole portion 75 even before the protrusive portion 74 is completely opposed to the hole portion 75, as shown in FIG. 56. Accordingly, the protrusive portions 74 can be fitted into the hole portions 75 with certainty.

Moreover, no matter which direction the treatment cell 2 is oriented in, the treatment cell 2 can be placed onto the receiving plate 71 by only positioning the convex portion 73 with respect to the concave portion 72. This is because if the receiving plate 71, on which the treatment cell 2 is placed, is rotated, a slippage occurs between the receiving plate 71 and the base plate 23 to cause each protrusive portion 74 to slip into a position opposite to the hole portion 75, and then the protrusive portions 74 are fitted into the hole portions 75.

Furthermore, according to the present embodiment, the treatment cell 2 can be detached from the vertical rotation shaft 3 due to the attachment and detachment means 7, and therefore, it is possible to easily perform the removal of the small objects 100 within the treatment cell 2, and/or the disassembly, assembly, cleaning and the like of the treatment cell 2.

Also, in the state where the treatment cell 2 is placed onto the receiving plate 71, a most part of the conductive base plate 23 is abutted against the entire upper face of the conductive receiving plate 71, and therefore, energization can be stably carried out from the vertical rotation shaft 3 to the electrode ring 21.

It should be noted that the attachment and detachment means 7 is also naturally applicable to surface treatment apparatuses to which the first embodiment through fourth embodiment are not applied.

In the attachment and detachment means 7, the convex portion 73 may be provided on the receiving plate 71 and the concave portion 72 may be provided at the base plate 23. The protrusive portion 74 may be provided at the base plate 23 and the hole portion 75 may be provided on the receiving plate 71.

INDUSTRIAL APPLICABILITY

The plating process apparatuses for small objects according to the present invention can solve all the various conventional problems, and are thus industrially very valuable.

The invention claimed is:

1. A surface treatment apparatus for a small object, the apparatus comprising:

a treatment cell; and a vertical rotation shaft for rotating the treatment cell around its rotational center on a horizontal plane, the apparatus performing a surface treatment on the small object while flowing out a surface treatment solution from the inside of the treatment cell to the outside thereof by rotating the treatment cell containing the small object, the apparatus characterized in that:

the treatment cell has a structure provided by superposing and combining a nonconductive bottom plate and a cover, and has a flow-out means for flowing out the surface treatment solution from the inside of the treatment cell to the outside thereof; and the flow-out means is a gap channel formed between adjacent thin plate members by sandwiching the thin plate members, each having a thickness smaller than a minimum dimension of each small object, between the bottom plate and the cover circumferentially at appropriate intervals.

2. A surface treatment apparatus for a small object, the apparatus comprising:

a treatment cell; and a vertical rotation shaft for rotating the treatment cell around its rotational center on a horizontal plane, the apparatus performing a surface treatment on the small object while flowing out a surface treatment solution from the inside of the treatment cell to the outside thereof by rotating the treatment cell containing the small object, the apparatus characterized in that:

the treatment cell has a structure provided by superposing and combining a nonconductive bottom plate and a cover, and has a flow-out means for flowing out the surface treatment solution from the inside of the treatment cell to the outside thereof; and the flow-out means is a gap channel consisting of a groove channel formed between the cover and the bottom plate so as to be communicated with the inside and outside of the treatment cell and so as to have a depth smaller than a minimum dimension of each small object.

3. The surface treatment apparatus for a small object according to claim 1, wherein the treatment cell has an electrode ring between the bottom plate and the cover, and has an energization means for energizing the electrode ring, wherein the surface treatment solution within the treatment cell is energized while the small object is brought into contact with the electrode ring and the surface treatment solution is flowed out from the inside of the treatment cell to the outside thereof by rotating the treatment cell containing the small object, thereby performing a surface treatment on the small object, and wherein the flow-out means is formed at least between the bottom plate and the electrode ring, between electrode ring layers of the electrode ring having a multilayer structure, or between the electrode ring and the cover.

4. The surface treatment apparatus for a small object according to claim 2, wherein the treatment cell has an electrode ring between the bottom plate and the cover, and has an energization means for energizing the electrode ring, wherein the surface treatment solution within the treatment cell is energized while the small object is brought into contact with the electrode ring and the surface treatment solution is flowed out from the inside of the treatment cell to the outside thereof by rotating the treatment cell containing the small object, thereby performing a surface treatment on the small object, and wherein the flow-out means is formed at least between the electrode ring and the bottom plate, between electrode ring layers of the electrode ring having a multilayer structure, or between the cover and the electrode ring.

5. The surface treatment apparatus for a small object according to claim 1, wherein an arbitrary number of the thin plate members are sandwiched in a superposed state.

6. The surface treatment apparatus for a small object according to claim 2, wherein a plurality of the groove channels are communicated with each other via a cutout portion formed by cutting out an inner edge of a surface at which the groove channels are formed.

7. The surface treatment apparatus for a small object according to claim 1, wherein a peripheral edge portion of the bottom plate is protuberant, and an inner face of the peripheral edge portion is inclined downward and inward.

8. The surface treatment apparatus for a small object according to claim 1, wherein the thin plate members are arranged circumferentially at arbitrary intervals.

9. The surface treatment apparatus for a small object according to claim 2, wherein the groove channel is provided to have an arbitrary width.

10. The surface treatment apparatus for a small object according to claim 1, wherein the apparatus comprises an attachment and detachment means for detachably fixing the treatment cell to the vertical rotation shaft, wherein the attachment and detachment means is formed to comprise:

a horizontal receiving plate which is fixed at an upper end of the vertical rotation shaft and on which the treatment cell is placeable;

a tapered concave portion formed at a rotational center of the receiving plate;

a convex portion provided at a rotational center of a lower face of the treatment cell and fitted into the concave portion;

protrusive portions provided at a plurality of positions of the receiving plate so as to be able to be protruded from an upper face thereof; and hole portions formed at the lower face of the treatment cell so that the protrusive portions, protruded from the upper face of the receiving plate, are fitted into the hole portions, and wherein a rotational force of the vertical rotation shaft is transmitted to the treatment cell via the receiving plate in the state where the convex portion of the treatment cell is fitted into the concave portion of the receiving plate and the protrusive portions of the receiving plate are fitted into the hole portions of the treatment cell.

11. The surface treatment apparatus for a small object according to claim 3, wherein an arbitrary number of the thin plate members are sandwiched in a superposed state.

12. The surface treatment apparatus for a small object according to claim 4, wherein a plurality of the groove channels are communicated with each other via a cutout portion formed by cutting out an inner edge of a surface at which the groove channels are formed.

13. The surface treatment apparatus for a small object according to claim 2, wherein a peripheral edge portion of the bottom plate is protuberant, and an inner face of the peripheral edge portion is inclined downward and inward.

14. The surface treatment apparatus for a small object according to claim 3, wherein a peripheral edge portion of the bottom plate is protuberant, and an inner face of the peripheral edge portion is inclined downward and inward.

15. The surface treatment apparatus for a small object according to claim 4, wherein a peripheral edge portion of the bottom plate is protuberant, and an inner face of the peripheral edge portion is inclined downward and inward.

16. The surface treatment apparatus for a small object according to claim 3, wherein the thin plate members are arranged circumferentially at arbitrary intervals.

17. The surface treatment apparatus for a small object according claim 4, wherein the groove channel is provided to have an arbitrary width.

18. The surface treatment apparatus for a small object according to claim 2, wherein the apparatus comprises an attachment and detachment means for detachably fixing the treatment cell to the vertical rotation shaft, wherein the attachment and detachment means is formed to comprise:

a horizontal receiving plate which is fixed at an upper end of the vertical rotation shaft and on which the treatment cell is placeable;

a tapered concave portion formed at a rotational center of the receiving plate;

a convex portion provided at a rotational center of a lower face of the treatment cell and fitted into the concave portion;

protrusive portions provided at a plurality of positions of the receiving plate so as to be able to be protruded from an upper face thereof; and hole portions formed at the lower face of the treatment cell so that the protrusive portions, protruded from the upper face of the receiving plate, are fitted into the hole portions, and wherein a rotational force of the vertical rotation shaft is transmitted to the treatment cell via the receiving plate in the state where the convex portion of the treatment cell is fitted into the concave portion of the receiving plate and the protrusive portions of the receiving plate are fitted into the hole portions of the treatment cell.

19. The surface treatment apparatus for a small object according to claim 3, wherein the apparatus comprises an attachment and detachment means for detachably fixing the treatment cell to the vertical rotation shaft, wherein the attachment and detachment means is formed to comprise:

a horizontal receiving plate which is fixed at an upper end of the vertical rotation shaft and on which the treatment cell is placeable;

a tapered concave portion formed at a rotational center of the receiving plate;

a convex portion provided at a rotational center of a lower face of the treatment cell and fitted into the concave portion;

protrusive portions provided at a plurality of positions of the receiving plate so as to be able to be protruded from an upper face thereof; and hole portions formed at the lower face of the treatment cell so that the protrusive portions, protruded from the upper face of the receiving plate, are fitted into the hole portions, and wherein a rotational force of the vertical rotation shaft is transmitted to the treatment cell via the receiving plate in the state where the convex portion of the treatment cell is fitted into the concave portion of the receiving plate and the protrusive portions of the receiving plate are fitted into the hole portions of the treatment cell.

20. The surface treatment apparatus for a small object according to claim 4, wherein the apparatus comprises an attachment and detachment means for detachably fixing the treatment cell to the vertical rotation shaft, wherein the attachment and detachment means is formed to comprise:

a horizontal receiving plate which is fixed at an upper end of the vertical rotation shaft and on which the treatment cell is placeable;

a tapered concave portion formed at a rotational center of the receiving plate;

a convex portion provided at a rotational center of a lower face of the treatment cell and fitted into the concave portion;

protrusive portions provided at a plurality of positions of the receiving plate so as to be able to be protruded from an upper face thereof; and hole portions formed at the lower face of the treatment cell so that the protrusive portions, protruded from the upper face of the receiving plate, are fitted into the hole portions, and wherein a rotational force of the vertical rotation shaft is transmitted to the treatment cell via the receiving plate in the state where the convex portion of the treatment cell is fitted into the concave portion of the receiving plate and the protrusive portions of the receiving plate are fitted into the hole portions of the treatment cell.

* * * * *